US006333147B1

(12) United States Patent
Toya

(10) Patent No.: US 6,333,147 B1
(45) **Date of Patent: *Dec. 25, 2001**

(54) THERMALLY PROCESSED IMAGE FORMING MATERIAL

(75) Inventor: Ichizo Toya, Minami-ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/568,681

(22) Filed: May 11, 2000

(30) Foreign Application Priority Data

May 11, 1999 (JP) ..... 11-130668

(51) Int. Cl.[7] ..... G03C 1/498

(52) U.S. Cl. ..... 430/619; 430/617; 430/635; 430/945

(58) Field of Search ..... 430/619, 617, 430/203, 635, 945

(56) References Cited

U.S. PATENT DOCUMENTS 6,165,707 * 12/2000 Hirano et al. ..... 430/619

* cited by examiner

*Primary Examiner*—Thorl Chea
(74) *Attorney, Agent, or Firm*—Birch, Stewart, Kolasch & Birch, LLP

(57) ABSTRACT

A thermally processed image forming material having on one side of a support at least one image recording layer containing at least one kind of non-photosensitive organic silver salt, a reducing agent for silver ion, and a binder; characterized by having at least one non-recordable layer formed by coating and drying a coating liquid containing a dicarboxylic acid and having a pH of 3.5 or above was disclosed. The thermally processed image forming material has an improved property of the coated surface and prevent coating streaks.

13 Claims, No Drawings

THERMALLY PROCESSED IMAGE FORMING MATERIAL

FIELD OF THE INVENTION

The present invention relates to a thermally processed image forming material and in particular to a photothermographic material.

RELATED ART

In recent years, a strong need for reducing the waste of processing solution has arisen in medical field from the viewpoints of environmental preservation and space saving. Thus desired is a technology related to a photothermographic material for medical diagnosis and graphic art use allowing efficient light exposure with a laser image setter or laser imager, and capable of providing a clear black image with a high resolution and sharpness. Such photothermographic material can provide the customer with a thermally-developing and processing without solution-base processing chemicals, allowing easy handling and no impact on the environment.

While a similar need has been occurring in the field of general image forming materials, images used in the medical diagnosis field specifically require a high image quality such as excellent sharpness and graininess for fine depiction, and prefer a blue-black tone for facilitating diagnoses. Although various hard copy system using pigment or dye, exemplified as an inkjet printer and electronic photograph system, are prevailing as a general image forming system, none of which is satisfactory as an output system for medical diagnosis images.

Other type of thermally processed image recording system using an organic silver salt and an agent for silver ion is known, for example, in U.S. Pat. Nos. 3,152,904 and 3,457,075 and "Thermally Processed Silver Systems" by D. Klosterboer, Imaging Processes and Materials, Neblette's 8th ed., edited by Sturge, V. Walworth and A. Shepp, chap.9, p.279, (1989). The photothermographic material generally has a photosensitive layer comprising a catalytic amount of photocatalyst (e.g., silver halide), reducing agent, reducible silver salt (e.g., organic silver salt), and an optional color toner for controlling color tone of silver image, all of which being dispersed in a binder matrix. The photothermographic material produces black silver image when heated, after light exposure, to a high temperature (e.g, 80° C. or above) through redox reaction between the silver halide or reducible silver salt and the reducing agent. Since the redox reaction is promoted by a catalytic action of a latent image on silver halide, which is generated by the light exposure, that the monotone silver image is formed in the exposed area. Such heat-assisted image forming system is disclosed in numbers of literatures typified by U.S. Pat. No. 2,910,377 and JP-B-43-4924 (the code "JP-B" as used herein means an "examined Japanese patent publication"), and can achieve a quality and tone satisfiable for medical diagnosis use.

A thermographic recording layer of such thermographic material and a non-recordable layer stacked thereon, or a photosensitive layer (photothermographic layer) of such photothermographic material and a non-photosensitive surface protective layer stacked thereon can be formed by simultaneous multi-layer coating. This method is strongly desired also from the viewpoint of cost reduction.

The simultaneous multi-layer coating has, however, been suffering from causing non-uniform coating due to streaks when effected in particular at a high speed (for example, 100 m/min or above), which has remained in further improvement.

SUMMARY OF THE INVENTION

In view of the problems in the prior art, an object of the present invention is to provide a thermally processed image forming material, for example a thermographic material and a photothermographic material, with an improved property of the coated surface, in particular coating streaks. More specifically, it is an object of the present invention to provide a photothermographic material for medical diagnoses with an improved coating streaks at the time of high-speed simultaneous multi-layer coating without degrading a maximum density.

The present inventors found after extensive investigations for solving the above problems that such generation of the coating streaks could be ascribable to a shock occurred around the interface during the simultaneous multi-layer coating due to the dicarboxylic acid contained in the non-recordable layer or non-photosensitive layer, and that the generation of the coating streaks could be successfully suppressed by controlling pH of the coating liquid, which led us to provide the present invention.

According to the present invention, provided is a thermally processed image forming material having on one side of a support at least one image recording layer containing at least one kind of non-photosensitive organic silver salt, a reducing agent for silver ion, nd a binder, characterized by having at least one non-recordable layer formed by coating and drying a coating liquid containing a dicarboxylic acid and having a pH of 3.5 or above.

In the present invention, water content of the total solvent in the coating liquid for forming the non-recordable layer is preferably 50 wt % or more, more preferably 80 wt % or more, still more preferably 95 to 100 wt %. The dicarboxylic acid is preferably selected from the group consisting of phthalic acids, maleic acids and naphthalenedicarboxylic acids, and more preferably selected from the group consisting of phthalic acid, 4-methylphthalic acid, 4-t-butylphthalic acid, 3-methylphthalic acid, 4,5-dimethylphthalic acid, 4-isopropylphthalic acid, 4-nitrophthalic acid, tetrachlorophthalic anhydride, maleic acid, and 2,3-naphthalenedicaroboxylic acid. The dicarboxylic acid is preferably contained in an amount of 1 to 2000 mg/m$^2$, more preferably 30 to 1000 mg/m$^2$ in the non-recordable layer, particularly in a surface protective layer. PH of the coating liquid is preferably 3.5 to 5.0 and more preferably 3.5 to 4.5. In the present invention, the image recording layer and the non-recordable layer are formed by simultaneous multi-layer coating. According to one embodiment of the present invention, the material is a photothermographic material further containing at least one kind of photosensitive silver halide.

It was made possible by the present invention to provide a thermally processed image forming material, a coating streak defect of which being improved even when it is produced by simultaneous coating.

DETAILED DESCRIPTION OF THE INVENTION

Preferred embodiments and actualization of the present invention will be detailed hereinafter The thermally processed image forming material of the present invention has on one side of a support at least one image recording layer containing at least one kind of non-photosensitive organic silver salt, a reducing agent for silver ion, and a binder, characterized by having at least one non-recordable layer formed by coating and drying a coating liquid containing dicarboxylic acids and having a pH of 3.5 or above. Using the coating liquid with such pH value affords an excellent effect such that suppressing the generation of the coating streaks.

The thermally processed image forming material of the present invention has on one side of a support at least one image recording layer containing at least one kind of non-photosensitive organic silver salt, a reducing agent for silver ion, and binder. The thermally image forming material of the present invention involves a thermographic material which image recording layer is a thermographic layer and a photothermographic material which image forming layer is photothermographic layer further containing a photosensitive silver halide.

The dicarboxylic acid available for the present invention may be any compound having two carboxylic groups, and among which preferably are phthalic acids, maleic acids and naphthalenedicarboxylic acids, all of which being used as a color (toning agent). Examples of the dicarboxylic acid used in the present invention include phthalic acid, 4-methylphthalic acid, 4-t-butylphthalic acid, 3-methylphthalic acid, 4,5-dimethylphthalic acid, 4-isopropylphthalic acid, 4-nitrophthalic acid, tetrachlorophthalic anhydride, maleic acid, and 2,3-naphthalenedicaroboxylic acid. Also allowable is an addition thereof in a form of anhydride or salts (for example, sodium salt, potassium salt and ammonium salt) generated in water composing the coating liquid. Phthalic acids are particularly preferable.

The dicarboxylic acid used in the present invention is preferably contained on the side having the image recording layer (or photosensitive layer) in an amount of 1 to 2000 mg/$^2$, and more preferably 30 to 1000 mg/m$^2$.

The dicarboxylic acid used in the present invention is contained in the non-recording layer or non-photosensitive layer, and more preferably in a surface protective layer. The surface protective layer in the context of the present invention refers to a non-recording layer provided on the image recording layer or photosensitive layer, and may be composed of a single layer or a plurality of layers (preferably 2 to 4 layers). The dicarboxylic acid may be contained as divided into a plurality of layers or in a single layer en bloc.

In the coating liquid containing such dicarboxylic acid, water preferably accounts for 50 wt % or more of the total volume of the solvent thereof, more preferably 80 wt % or more, and still more preferably 95 to 100 wt %.

In the present invention, pH of the coating liquid containing the dicarboxylic acid is adjusted at 3.5 or above. A value of pH lower than 3.5 may undesirably result in generating coating streaks. While there is no specific limitation on the upper limit of pH, the preferable value resides in a range from 3.5 to 5.0, and more preferably 3.5 to 4.5.

Adjustment of pH can be effected by using a base or acid, and more specifically by using NaOH, $NH_4OH$, LiOH, KOH, $H_2SO$ and $HNO_3$.

The thermally processed image forming material of the present invention contains a non-photosensitive organic silver salt. The organic silver salt used in the present invention is a silver salt which is relatively stable against light exposure but can produce silver image when heated at 80° C. or higher in the presence of light-exposedn photocatalyst (e.g. latent image of photosensitive silver halide) and reducing agent. The organic silver salt may be any organic substance containing a source capable of reducing the silver ion. Such non-photosensitive organic silver salts are described in paragraphs [0048] to [0049] of JP-A-10-62899 (the code "JP-A" as used herein means an "unexamined published Japanese patent application"), and from nline 24 on page 18 to line 37 on page 19 of European Laid-Open Patent Publication No. 0803763A1. Silver salt of organic acid, in particular, silver salt of long-chained aliphatic carboxylic acid (with a carbon number of 10 to 30, and preferably 15 to 28) is preferred The organic silver salt may preferably constitute approx. 5 to 70 wt % of the image-recording layer. Preferable organic silver salt includes silver salt of organic compound having carboxyl group. Examples thereof include silver salts of aliphatic carboxylic acid and aromatic carboxylic acid, while not being limited thereto. Preferred examples of the silver salt of the aliphatic carboxylic acid include silver behenate, silver arachidinate, silver stearate, silver oleate, silver laurate, silver caproate, silver myristate, silver palmitate, silver maleate, silver fumarate, silver tartrate, silver linoleate, silver butyrate, silver camphorate and mixtures thereof. In the present invention, silver behenate preferably accounts for 90 to 100 mol % of the organic silver salt.

While there is no special limitation on particle shape of the organic silver salt available in the present invention, scaly organic silver salt is preferable. Here the scaly organic silver salt in the present invention is defined as follows. First, particle of the organic acid silver salt is microscopically observed and the shape thereof is approximated as a rectangular parallelepiped. Edges of the rectangular parallelepiped are denoted as "a", "b" and "c" in the order from the shortest length (a same length for "b" and "c" also allowable), then "x" is calculated as follows using "a" and "b" corresponded to two lengths from the shortest:

$$x=b/a$$

In such a way, "x"s are obtained for approx. 200 particles and obtain an average "x(average)" thereof, in which those satisfying a relation of x(average)≧1.5 are defined as scaly, preferably satisfying 30≧x(average)≧1.5, and more preferably 20≧x(average) ≧2.0. For reference, acicular form is defined for those satisfying a relation of 1≧x(average)<1.5.

For a scaly particle, "a" can be corresponded to a thickness of a tabular particle having "b" and "c" as edges of the major surface thereof. An average of "a" is preferably 0.01 to 0.23 μm, and more preferably 0.1 to 0.20 μm. An average of "c/b" is preferably 1 to 6, more preferably 1.05 to 4, still more preferably 1.1 to 3, and most preferably 1.1 to 2.

Particle size distribution of the organic silver salt is preferably of monodisperse. The term "monodisperseo as used herein means that the percentage of the value obtained by dividing the standard deviation of the length of the short axis or long axis by the length of the short axis or long axis, respectively, is preferably 100% or less, more preferably 80% still or less, still more preferably 50% or less. The shape of the organic silver salt can be determined based on the image of organic silver salt dispersion observed with a transmission electron microscope. Another method for determining the monodispersibility is such that obtaining the standard deviation of volume weighted mean diameter of the organic silver salt. The percentage (coefficient of variation) of the value obtained by dividing the standard deviation by the volume weighted mean diameter is preferably 100% or less, more preferably 80% or less, still more preferably 50% or less. The measurement procedures include irradiating laser light to the organic silver salt dispersed in a solution; deriving an autocorrelation function with respect to the time-dependent fluctuation in the scattered light; and thereby obtaining grain size (volume weighted mean diameter).

The organic silver salt available in the present invention can be prepared by reacting a solution or suspension of alkali metal salt (exemplified as sodium salt, potassium salt and lithium salt) of the above-described organic acid with silver nitrate. The alkali metal salt of the organic acid is obtained by alkali treatment of the above-described organic acid. The organic silver salt can be prepared in an arbitrary proper vessel in a batch or continuous manner. Stirring in the reaction vessel may be effected with an arbitrary stirring method according to target properties of the particles. Preferable methods applicable for preparing the organic silver salt include such that adding abruptly or gradually an aqueous silver nitrate solution into a reaction vessel containing a solution or suspension of the alkali metal salt of the organic acid; such that adding abruptly or gradually a previously prepared solution or suspension of the alkali metal salt of the organic acid into a reaction vessel containing an aqueous silver nitrate solution; and such that pouring at a time into a reaction vessel an aqueous silver nitrate solution and a solution or suspension of the alkali metal salt of the organic acid, both of which being previously prepared.

The aqueous silver nitrate solution, and solution or suspension of the alkali metal salt of the organic acid may be of an arbitrary concentration and may be added at an arbitrary rate of addition to control the particle size. The addition of the aqueous silver nitrate solution, or solution as well as suspension of the alkali metal salt of the organic acid may be effected at a constant addition rate, or accelerated or decelerated addition rate according to an arbitrary time-related function. Either addition onto the surface of the solution or into the solution are allowable. When an aqueous silver nitrate solution and a solution or suspension of the alkali metal salt of the organic salt, both being previously prepared, are poured at a time into a reaction vessel, either the aqueous silver nitrate solution, or the solution or suspension of the alkali metal salt of the organic acid may precedently poured, where the aqueous silver nitrate solution is preferably poured in a preceding manner. A degree of precedence may preferably be 0 to 50 vol % of the total addition, and more preferably 0 to 25 vol %. It is also preferable as disclosed in JP-A-9-127643 to add the solution while controlling pH or silver potential of the reaction solution during the reaction.

The aqueous silver nitrate solution, or the solution or suspension of the alkali metal salt of the organic acid may have pH thereof adjusted according to target properties of the resultant particles. An arbitrary acid or alkali can be added for the pH control. Temperature of the content in the reaction vessel can arbitrarily be set to control the particle size of the organic acid silver salt, and the same will apply to the aqueous silver nitrate solution to be added, or the solution or suspension of the alkali metal salt of the organic acid to be added. The solution or suspension of the alkali metal salt of the organic acid is preferably kept by heating at 50° C. or above to ensure a proper fluidity thereof.

The organic acid silver salt used in the present invention is preferably prepared in the presence of a tertiary alcohol. The tertiary alcohol used in the present invention preferably has a total carbon number of 15 or below, and more preferably 10 or below. A preferable example of such tertiary alcohol relates to tert-butanol, while not being limited thereto.

While the tertiary alcohol used in the present invention may be added at any timing during the preparation of the organic silver salt, it is preferable to add the alcohol at the time of preparation of the alkali metal salt of the organic acid and to use the alkali metal salt of the organic acid in a dissolved state. Amount of addition of the tertiary alcohol may be set at an arbitrary ratio by weight within a range from 0.01 to 10 relative to $H_2O$ as a solvent used for preparing the organic acid silver salt, and preferably from 0.03 to 1.

When the scaly organic acid silver salt valuable in the present invention is produced by reacting an aqueous solution containing a water-soluble silver salt and an aqueous tertiary alcohol solution containing the alkali metal salt of the organic acid (including a step for adding into a solution in the reaction vessel an aqueous tertiary alcohol solution containing the alkali metal of the organic acid), it is preferable to keep the temperature difference between the solution in the reaction vessel and the aqueous tertiary alcohol solution containing the alkali metal salt of the organic acid within a range from 20 to 85° C.; the solution in the reaction vessel being preferably a pre-charged aqueous solution containing the water-soluble silver salt, or, for the case that the aqueous solution containing the water-soluble silver salt is added, rather than in precedence, at the same time with the aqueous tertiary alcohol solution containing the alkali metal salt of the organic acid, being water or a mixed solvent of water and the tertiary alcohol, which may previously be contained in the vessel also for the case that the aqueous solution containing the water-soluble silver salt is previously poured.

Crystal form or the like of the organic acid silver salt is preferably controlled by keeping such temperature difference during the addition of the aqueous tertiary alcohol solution containing the alkali metal salt of the organic acid.

The water-soluble silver salt is preferably silver nitrate, concentration of the water-soluble silver salt in the aqueous solution is preferably 0.03 to 6.5 mol/l, more preferably 0.1 to 5 mol/l, and pH of the aqueous solution is preferably 2 to 6, more preferably pH3.5 to 6.

A tertiary alcohol with a carbon number of 4 to 6 may be contained, content by volume of which being 70% or less relative to the total volume of the aqueous solution of the water-soluble silver salt, and more preferably 50% or less. Temperature of the aqueous solution is preferably 0 to 50° C., more preferably 5 to 30° C., and most preferably 5 to 15° C. in particular for the case that the aqueous solution containing the water-soluble silver salt and the aqueous tertiary alcohol solution containing the alkali metal salt of the organic acid are added at a time as described later.

The alkali metal composing the alkali metal salt of the organic acid is typified as sodium or potassium. The alkali metal salt of the organic acid is prepared by adding NaOH or KOH to an organic acid, in which it is preferable to suppress an amount of the alkali metal equivalent to or less than that of the organic acid so that a part of the organic acid will remain unreacted. An amount of the residual organic acid is 3 to 50 mol % relative to 1 mol of the total organic acid, and preferably 3 to 30 mol %. It is also allowable in the preparation to add an excessive amount of alkali and then added acid such as nitric acid or sulfuric acid to neutralize the excessive portion of alkali.

Controlling pH is also allowable depending on target properties of the organic acid silver salt. An arbitrary acid or alkali can be used for the pH control.

In the present invention, the aqueous solution containing the water-soluble silver salt, the aqueous tertiary alcohol solution containing the alkali metal salt of the organic acid, and the pre-charged solution in the reaction vessel may be added with, for example, a compound expressed by the general formula (1) of JP-A-62-65035, a water-soluble N-heterocyclic compound having a solubility-expressing group as disclosed in JP-A-62-150240, an inorganic peroxide as disclosed in JP-A-50-101019, a sulfur compound as disclosed in JP-A-51-78319, a disulfide compound as disclosed in JP-A-57-643 and hydrogen peroxide.

The aqueous tertiary alcohol solution containing the alkali metal salt of the organic acid used in the present invention is preferably a mixed solvent of a tertiary alcohol with a carbon number of 4 to 6 and water to ensure uniformity of the solution. A carbon number exceeding the above range is undesirable since such alcohol is not compatible with water. Among alcohols with a carbon number of 4 to 6, most preferable is tert-butanol most compatible with water. Alcohols other than tertiary alcohol are not preferable as described above since such alcohols have reducing properties so as to cause troubles when the organic acid silver salt is formed. An amount by volume of the tertiary alcohol used in the aqueous tertiary alcohol solution containing the alkali metal salt of the organic acid is 3 to 70% of the volume of the aqueous portion of such aqueous tertiary alcohol solution, and more preferably 5 to 50%.

A concentration by weight of the alkali metal salt of the organic acid in the aqueous tertiary alcohol solution containing thereof is 7 to 50 wt %, more preferably 7 to 45% and still more preferably 10 to 40 wt %.

Temperature of the aqueous tertiary alcohol solution containing the alkali metal salt of the organic acid to be charged into the reaction vessel is maintained preferably within a range from 50 to 90° C., more preferably from 60 to 85° C., and most preferably from 65 to 85° C., so as to avoid crystallization or solidification of the alkali metal salt of the organic acid. The temperature is preferably be controlled at a certain temperature selected from the above range to keep the reaction temperature constant.

The organic acid silver salt used in the present invention is prepared either by i) a method such that the aqueous tertiary alcohol solution containing the alkali metal salt of the organic acid is poured by a single addition process operation into the reaction vessel pre-charged with an entire volume of the solution containing the water-soluble silver salt; or ii) a method such that having a time period in which the aqueous solution of the water-soluble silver salt and the aqueous tertiary alcohol solution containing the alkali salt of the organic acid are concomitantly added (concomitant addition process). The latter method based on the concomitant addition is more preferable in the present invention in terms of controlling the average particle size of the organic acid silver salt and narrowing the distribution thereof. In such a case, it is preferable that 30 vol % or more of the total addition is concomitantly added, and more preferably 50 to 75 vol %. When either solution is precedently added, the solution containing the water-soluble silver salt in precedence is more preferable.

In both cases, temperature of the solution in the reaction vessel (i.e. the aqueous solution of the water-soluble silver salt precedently charged, or for the case without such precedent charging, the solvent pre-charged in the reaction vessel as described later) is preferably 5 to 75° C., more preferably 5 to 60° C., and most preferably 10 to 50° C. While the temperature is preferably be controlled over the entire process of the reaction at a certain temperature selected from the above range, it is also allowable to control the temperature within the above range according to several temperature patterns.

In the present invention, temperature difference between the aqueous tertiary alcohol solution containing the alkali metal salt of the organic acid and the solution in the reaction vessel is preferably within a range from 20 to 85° C., and more preferably from 30 to 80° C. In this case, the aqueous tertiary alcohol solution containing the alkali metal salt of the organic acid preferably has a higher temperature.

Based on such temperature definition, deposition rate of microcrystalline alkali metal salt of the organic acid from the aqueous tertiary alcohol solution upon rapid cooling in the reaction vessel and production rate of the organic silver salt through reaction with the water-soluble silver salt are properly controlled thereby to properly control crystal form, crystal size and crystal size distribution of the organic silver salt, which concomitantly result in improved properties as a heat-developable material, and in particular as a photothermographic material.

The reaction vessel can be pre-charged with a solvent. While the pre-charged solvent is preferably water, a mixed solvent thereof with the tertiary alcohol is also allowable. A dispersion aid soluble to water-base medium may be added to the aqueous tertiary alcohol solution of the alkali metal salt of the organic acid, aqueous solution of the water-soluble silver salt or reaction solution. The dispersion aid may be of any type provided that it can disperse the produced organic acid silver salt. Specific examples thereof complies with those described later in relation to the organic acid silver salt.

In a process of producing the organic acid silver salt in the present invention, it is preferable to provide a desalting and dewatering step after the production of the silver salt. There is no specific limitation on the method therefore, and any of well-known practical means is applicable. Known filtration methods such as centrifugal filtration, suction filtration, ultrafiltration and flocculation washing based on coagulation; and supernatant removal after centrifugal separating sedimentation are preferably used. The desalting and dewatering may be effected once or repeated plural times. Addition and removal of water may be effected continuously or independently. The desalting and dewatering is effected so as to preferably obtain a conductivity of the finally recovered water of approx. 300 $\mu$S/cm or lower, more preferably 100 $\mu$S/cm or lower, and most preferably 60 $\mu$S/cm or lower. While the lower limit of the conductivity is not specifically limited, it is 5 $\mu$S/cm or around in general.

To obtain desirable properties of the coated surface with the heat-developable material, in particular with the photothermographic material, it is preferable to first prepare a water-base dispersion of the organic acid silver salt, convert it into a high-speed flow under a high pressure, drop the pressure thereof to effect re-dispersion, thereby to obtain a fine water-base dispersion. Although the dispersion medium in this case preferably consists of water only, the medium may contain organic solvent within a content of 20 wt %.

The organic acid silver salt can mechanically be dispersed in a form of fine particles in the presence of a dispersion aid using a known pulverizing means (e.g. high-speed mixer, homogenizer, high-speed impact mill, banbury mixer, homomixer, kneader, ball mill, vibration ball mill, epicyclic ball mill, attritor, sand mill, bead mill, colloid mill, jet mill, roller mill, trommel and high-speed stone mill).

It is preferable that the dispersion is effected in the absence of the photosensitive silver salt, since coexistence of the photosensitive silver salt during the dispersion may increase fog and significantly lower the sensitivity. In the present invention, a content of the photosensitive silver salt in the water-base dispersion to be dispersed is 0.1 mol % or less relative to 1 mol of the organic acid silver salt contained therein, without any intentional addition of the photosensitive silver salt.

To obtain a solid dispersion of the organic silver salt with a high S/N ratio, small grain size and no coagulation, it is preferable in the present invention to apply a large force to the particles of the organic silver salt as an image forming medium within a range such that not causing fracture or excessive temperature rise of the particles. Thus preferable is a dispersion method such that converting a water-base dispersion comprising the organic silver salt and aqueous dispersant solution into a high-speed flow, and then dropping the pressure thereof.

Solid dispersion apparatuses and technologies available for implementing the above re-dispersion in the present invention are detailed, for example, in "Bunsankei Reoroji to Bunsanka Gijutsu (Dispersed System Rheology and Dispersion Technology)", by Toshio Kajiuchi and Hiroki Usui, 1991, issued by Sinzansha Shuppan, p.357–403; "Kagaku Kogaku no Sinpo (Advances in Chemical Engineering) Vol.24", ed. Tokai Section, The Society of Chemical Engineers, 1990, issued by Maki Shoten, p.184–185; JP-A-59-49832; U.S. Pat. No. 4,533,254; JP-A-8-137044; JP-A-8-238848; JP-A-2-2615251; and JP-A-1-94933. A dispersion method employed in the present invention is such that feeding the water-base dispersion containing at least organic silver salt into a piping while being pressurized with a high-pressure pump or the like, allowing the dispersion to pass through a narrow slit, and then causing an abrupt pressure drop to the dispersion thereby completing a fine dispersion.

As for a high-pressure homogenizer available in the present invention, an uniform and effective dispersion is generally considered to be effected, without altering neither (a) "shearing force" generated when dispersoid passes through a narrow gap (approx. 75 to 350 $\mu$m) under a high pressure and at a high speed, nor (b) "cavitation force" generated by liquid-liquid collision or collision against a wall in a pressurized narrow space, by enhancing the cavitation force by the succeeding pressure drop. Galling homogenizer has long been known as such kind of dispersion apparatus, in which a pressure-fed solution to be dispersed is converted into a high-speed flow at a narrow gap on a cylinder surface, then rushed to be collided with the peripheral wall, thereby allowing emulsification or dispersion assisted by the impact force. The liquid-liquid collision can be effected, for example, in a Y-type chamber of a microfluidizer and a spherical chamber using a ball type check valve as disclosed in JP-A-8-103642 described later, and the liquid-wall collision can be effected, for example, in a Z-type chamber of a microfluidizer. Operating pressure is, in general, selected in a range from 100 to 600 kg/cm$^2$, and flow rate in a range several to 30 m/second. There is also proposed an apparatus such that having a sawtoothed high flow rate portion to increase the number of collision for a higher dispersion efficiency. Typical examples of such apparatuses include galling homogenizer, microfluidizer manufactured by Microfluidex International Corporation or Mizuho Kogyo K.K., and Nanomizer manufactured by Tokushu Rika Xogyo Co., Ltd. Such apparatuses are also disclosed in JP-A-8-238848, JP-A-8-103642 and U.S. Pat. No. 4,533,254.

In the present invention, it is possible to disperse the organic silver salt so as to attain a desired grain size by properly adjusting the flow rate, pressure difference at the time of the pressure drop and the number of repetition of the process. Taking photographic properties and the grain size into account, the flow rate is preferably from 200 to 600 m/sec, more preferably from 300 to 600 m/sec, and the pressure difference at the pressure drop is preferably from 900 to 3000 kg/cm$^2$, and more preferably from 1500 to 3000 kg/cm$^2$. The number of repetition of the process is selectable as required. While this is generally selected as once to as much as 10 times, once to as much as 3 times is preferred from the viewpoint of productivity. Raising the temperature of such water-base dispersion under high pressure is undesirable from the viewpoint of dispersibility and photographic properties, that is, raising the temperature above 90° C. tends to result in increased grain size and increased fogging. It is thus preferable in the present invention to provide a cooling step before the conversion into the high-pressure, high-speed flow and/or after the pressure drop, to maintain the temperature of the water-base dispersion within a range from 5 to 90° C., more preferably from 5 to 80° C. and still more preferably 5 to 65° C. Providing such cooling step is particularly effective when the dispersion is proceeded under the pressure as high as 1500 to 3000 kg/cm$^2$. A cooler is properly selected, depending on the required capacity of heat exchange, from those being equipped with a double pipe or triple pipe as combined with a static mixer; shell-and-tube heat exchanger; and coiled heat exchanger. The diameter, wall thickness and material of the pipe are properly be selected, considering the operating pressure, so as to improve the efficiency of the heat exchange. Coolants available for the cooler is selectable, depending on the required amount of heat exchange, from well water at 20° C.; cold water at 5 to 10° C.fed from a chiller; and, as requested, ethylene glycol/water at −30° C.

When the organic silver salt is solid-dispersed in the presence of a dispersion aid, the dispersion aid can be suitably selected from, for example, synthetic anionic polymers such as polyacrylic acid, copolymers of acrylic acid, maleic acid copolymers, maleic monoester copolymers and acryloylmethylpropanesulfonic acid copolymers; semi-synthetic anionic polymers such as carboxymethylated starch and carboxymethyl cellulose; anionic polymers such as alginic acid and pectic acid; anionic surfactants disclosed in JP-A-52-92716 and WO. 88/04794; compound disclosed in JP-A-9-179243; known anionic, nonionic and cationic surfactants; other known polymers such as polyvinyl alcohol, polyvinylpyrrolidone, carboxymethyl cellulose, hydroxypropyl cellulose, and hydroxypropylmethyl cellulose; naturally occurring polymers such as gelatin and the like. Most preferable are polyvinyl alcohols and water-soluble cellulose derivatives.

The dispersant is generally mixed with the organic silver salt in a form of powder or wet cake before the dispersing operation, and fed as slurry into a dispersion apparatus, whereas the dispersant may also be included in the powder or wet cake by heat treatment or solvent treatment of the dispersant premixed with the organic silver salt. The pH may be controlled with a suitable pH adjusting agent during or after the dispersing operation.

Besides such mechanical dispersing operation, the organic silver salt can preliminarily be dispersed into solvent by pH control, and then can thoroughly be dispersed by altering pH under the presence of the dispersion aid. The solvent for the preliminary dispersion may be organic solvent, which is generally removed after the thorough dispersion.

The produced dispersion can be stored under stirring in order to prevent precipitation of the microparticles during storage, or stored in a highly viscous state by producing hydrophilic colloid (e.g jelly state formed with gelatin). Further, it may be added with a preservative in order to prevent germ proliferation during the storage.

The organic silver salt obtained by the preparation method described in the above is preferably dispersed in a water-base solvent and then mixed with the aqueous solution of the photosensitive silver salt to be provided as a coating liquid for a photosensitive image forming medium.

Prior to the dispersion operation, the source liquid is roughly dispersed (preliminary dispersion). The preliminary dispersion is effected by using a known dispersion means (eg high-speed mixer, homogenizer, high-speed impact mill, banbury mixer, homomixer, kneader, ball mill, vibration ball mill, epicyclic ball mill, attritor, sand mill, bead mill, colloid mill, jet mill, roller mill, trommel and high-speed stone mill). Besides such mechanical dispersing operation, the organic silver salt can preliminarily be dispersed into solvent by pH control, and then can thoroughly be dispersed by altering pH under the presence of the dispersion aid. The solvent for the preliminary, dispersion may be organic solvent, which is generally removed after the thorough dispersion.

The aqueous solution of the photosensitive silver salt is mixed after such dispersion to produce a coating liquid for a photosensitive image-forming medium. Using such coating liquid ensures a thermally processed image forming material with a low haze, low fog and high sensitivity. On the other hand, presence of the photosensitive silver salt at the time of dispersion through the conversion into high-pressure, high-speed flow tends to result in increased fog and significantly lowered sensitivity, using organic solvent, in place of water, also tends to raise the haze, increase the fog and lower the sensitivity. In place of mixing the aqueous solution of the photosensitive silver salt, employing the conversion method, in which a part of the organic silver salt in the dispersion is converted into photosensitive silver salt, may lower the sensitivity.

In the above, the water-base dispersion to be dispersed after converted into a high-pressure and high-speed flow substantially contains no photosensitive silver salt, and the content thereof is 0.1 mol % or less relative to 1 mol of the non-photosensitive organic silver salt contained therein, without any intentional addition of the photosensitive silver salt.

Particle size (volume weighted mean diameter) of the solid particle dispersion of the organic silver salt used in the present invention can be measured by irradiating laser light to the solid particle dispersed in the solution, obtaining an autocorrelation function with respect to the time-dependent fluctuation in the scattered light, and then deriving such particle size. Preferable is a solid particle dispersion with an average particle size of 0.05 to 10.0 $\mu$m, more preferably 0.1 to 5.0 $\mu$m, and still more preferably 0.1 to 2.0 $\mu$m.

The solid particle dispersion of the organic silver salt used in the present invention comprises at least the organic silver salt and water. While there is no specific limitation on the ratio of the organic silver salt and water, the organic silver salt preferably accounts for 5 to 50 wt % of the whole dispersion, and more preferably 10 to 30 wt %. Using the above-described dispersion aid is preferable provided that it is used in a minimum amount within a range suitable for minimizing the particle size, and preferable range thereof is 1 to 30 wt % relative to the organic silver salt, and more preferably 3 to 15 wt %.

In the present invention, a photosensitive material can be prepared by mixing the water-base dispersion of the organic silver salt and water-base dispersion of the photosensitive silver salt, where a mixing ratio of the organic silver salt and photosensitive silver salt can be selected according to target properties. A ratio of the photosensitive silver salt to the organic silver salt is preferably 1 to 30 mol %, more preferably 3 to 20 mol %, and still more preferably 5 to 15 mol %. Mixing two or more kinds of water-base dispersion of the organic salt and two or more kinds of water-base dispersion of the photosensitive silver salt is a preferable method for controlling photographic properties.

The organic silver salt can be used in a desired amount, where 0.1 to 5 g/m$^2$ as an amount of silver is preferable and 1 to 3 g/m$^2$ is mote preferable.

The thermally processed image forming material of the present invention contains a reducing agent for the organic silver salt (silver ion). The reducing agent for the organic silver salt may be an arbitrary compound capable of reducing silver ion to metal silver, and preferably such organic compound. While conventional photographic developers such as phenidone, hydroquinone and catechol are also useful, preferable is a hindered phenol compound (for example, bis(2-hydroxy-3-t-butyl-5-methyl-phenyl) methane, 2,2-bis(4-hydroxy-3-methylphenyl)propane, 4,4-ethylidene-bis(2-t-butyl-6-methylphenol), 1,1-bis(2-hydroxy-3,5-dimethylphenyl)-3,5,5-trimethylhexane and 2,2-bis(3,5-dimethyl-4-hydroxyphenyl)propane). Such reducing agents are disclosed in paragraphs [0052] to [0053] of JP-A-10-62899 and line 34 on page 7 to line 12 on page 18 of European Laid-Open Patent Publication No. 0803764A1.

An amount of addition of the reducing agent is preferably 0.01 to 5.0 g /m$^2$, more preferably 0.1 to 3.0 g/m$^2$, and 5 to 50 mol % relative to 1 mol of silver presents on the same side with the image recording layer, and more preferably 10 to 40 mol %. A layer to which the reducing agent is added may be any layer on the surface on which the image-forming layer is provided. In the case of adding the reducing agent to a layer other than the image-recording layer, the reducing agent is preferably used in a slightly larger amount of from 10 to 50 mol % per one mol of silver. The reducing agent may also be a so-called precursor which is derived to effectively exhibit its function only at the time of development.

The reducing agent used in the present invention may be added in any form of solution, powder or solid microparticle dispersion. Dispersion of the solid microparticle is effected using a known pulverizing means (e.g. ball mill, vibrating ball mill, sand mill, colloid mill, jet mill and roller mill). A dispersion aid may be available for dispersing the solid microparticle.

In one embodiment of the present invention, the thermally processed image forming material contains a photosensitive silver halide. The photosensitive silver halide used in the present invention has no limitation with regard to its halogen composition, and any of silver chloride, silver chlorobromide, silver bromide, silver iodobromide and silver iodochlorobromide is available. The halogen composition distribution within the grain may be uniform, or the halogen composition may be changed stepwise or continuously. Silver halide grain with a core/shell structure may preferably be used, in which the structure is preferably of two-fold to five-fold, and more preferably of two-fold to four-fold. It is also preferable to adopt a technique for localizing silver bromide on the surface of silver chloride or silver cholorobromide.

Methods for producing photosensitive silver halide used in the present invention are well known in the art, and, for example, the methods described in Research Disclosure, No. 17029 (June, 1978) and U.S. Pat. No. 3,700,458 may be applied. More specifically, photosensitive silver halide is first prepared by adding a silver source compound and a halogen source compound in a solution containing gelatin or other polymer, which is then mixed with an organic silver salt.

The photosensitive silver halide grain preferably has a small grain size so as to prevent high white turbidity after image production. Specifically, the grain size is preferably 0.20 $\mu$m or less, more preferably from 0.01 to 0.15 $\mu$m, still more preferably from 0.02 to 0.12 $\mu$m. The term "grain size" as used herein means the length of an edge of the silver halide grain for the case that the grain is a normal crystal having cubic or octahedral shape; and means the diameter of a sphere having a volume equal to that of the silver halide grain for the case that the grain has other irregular shape such as sphere or rod; and means the diameter of a circle image having an area equal to the projected area of the major plane of the silver halide grain for the case that the grain is tabular.

Examples of the shape of the silver halide grain include cubic, octahedral, tabular, spherical, rod and pebble; among these, cubic and tabular shapes being preferred in the present invention. When a tabular silver halide grain is used, the average aspect ratio is preferably from 100:1 to 2:1, more preferably from 50:1 to 3:1. A silver halide grain having rounded corners is also preferably used. The plane indices (Miller indices) of the outer surface plane of a photosensitive silver halide grain is not particularly limited; however, it is preferred that [100] plane showing a high spectral sensitization efficiency upon adsorption of the spectral sensitizing dye occupies a large percentage. The percentage is preferably 50% or above, more preferably 65% or above, still more preferably 80% or above. The percentage of a plane with a Miller index of [100] can be determined by the method described in T. Tani, J. Imaging Sci., 29, 165 (1985), which is based on the plane dependency of adsorption of the sensitizing dye between [111] and [100] planes.

The photosensitive silver halide grain for use in the present invention contains a metal of Groups VIII to X in the Periodic Table (expressing Groups I to XVIII), or complexes thereof. The metal of Groups VIII to X in the Periodic Table, or a center metal of the metal complex is preferably rhodium, rhenium, ruthenium, osmium or iridium. These metal complexes may be used individually, or in combination of two or more complexes of the same metal or different metals. A content of the metal complex is preferably from $1\times10^{-9}$ to $1\times10^{-3}$ mol per one mol of silver, and more preferably from $1\times10^{-9}$ to $1\times10^{-4}$ mol. A specific structure of such metal complex available in the present invention is exemplified as that disclosed in JP-A-7-225449.

As the rhodium compound, preferably used in the present invention relates to a water-soluble rhodium compound. Examples thereof include a rhodium(III) halide compounds; and rhodium complex salts having a halogen, amines or an oxalates as ligands, such as hexachlororhodium(III) complex salt, pentachloroaquorhodium(III) complex salt, tetrachlorodiaquorhodium(fII) complex salt, hexabromorhodium(III) complex salt, hexamminerhodium (III) complex salt and trioxalatorhodium(III) complex salt. These rhodium compounds are used in a dissolved form in water or other appropriate solvent, where a method commonly used for stabilizing the rhodium compound solution may be applied, in which an aqueous hydrogen halide solution (e.g. hydrochloric acid, bromic acid, fluoric acid) or alkali halide (e.g. KCl, NaCl, KBr, NaBr) is added. In place of using the water-soluble rhodium, separate silver halide grains pre-doped with rhodium may be added and dissolved at the time of preparation of silver halide.

An amount of addition of the rhodium compound is preferably from $1\times10^{-8}$ to $5\times10^{-6}$ mol per one mol of silver halide, and more preferably from $5\times10^{-8}$ to $1\times10^{-6}$ mol.

The rhodium compound may appropriately be added at the time of production of silver halide emulsion grains or at respective stages before coating of the emulsion, where more preferable is to add the compound at the time of emulsion production to be incorporated into the silver halide grain.

Rhenium, ruthenium or osmium for use in the present invention is added in the form of water-soluble complex salt described in IP-A-63-2042, JP-A-1-285941, JP-A-2-20852 and JP-A-2-20855. An exceptionally preferred example thereof refers to a hexacoordinative complex salt represented by the following formula:

$$[ML_6]^{n-}$$

wherein M represents Ru, Re or Os; and n represents 0, 1, 2, 3 or 4.

In this case, ammonium or alkali metal ion is used as counter ion, while the ion being of no importance.

Preferred examples of the ligand include halide ligand, cyanide ligand, cyanoxide ligand, nitrosyl ligand and thionitrosyl ligand. Specific examples of the complex for use in the present invention are shown below, while not being limited thereto.

| | | | |
|---|---|---|---|
| $[ReCl_6]^{3-}$ | $[ReBr_6]^{3-}$ | $[ReCl_5(NO)]^{2-}$ | $[Re(NS)Br_5]^{2-}$ |
| $[Re(NO)(CN)_5]^{2-}$ | $[Re(O)_2(CN)_4]^{3-}$ | | $[RuCl_6]^{3-}$ |
| $[RuCl_4(H_2O)_2]^{-}$ | $[RuCl_5(H_2)]^{2-}$ | | $[RuCl_5(NO)]^{2-}$ |
| $[RuBr_5(NS)]^{2-}$ | $[Ru(CO)_3Cl_3]^{2-}$ | | $[Ru(CO)Cl_5]^{2-}$ |
| $[Ru(CO)Br_5]^{2-}$ | $[OsCl_6]^{3-}$ | | $[OsCl_5(NO)]^{2-}$ |
| $[Os(NO)(CN)_5]^{2-}$ | $[Os(NS)Br_5]^{2-}$ | | $[Os(O)_2(CN)_4]^{4-}$ |

The amount of addition of these compounds is preferably from $1\times10^{-9}$ to $1\times10^{-5}$ mol per one mol of silver halide, and more preferably from $1\times10^{-8}$ to $1\times10^{-6}$ mol.

These compounds may be added appropriately at the time of preparation of silver halide emulsion grains or at respective stages before coating of the emulsion, where more preferable is to add the compound at the time of emulsion production to be incorporated into the silver halide grain.

As for adding the compound during the grain formation of silver halide and integrating it into a silver halide grain, applicable methods include such that previously adding an aqueous solution of metal complex powder together with or without NaCl or KCl to a solution of water-soluble salt or water-soluble halide during the grain formation; such that adding the compound as the third solution at the time of simultaneously mixing the silver salt and the halide solution to prepare silver halide grains by the triple jet method; and such that pouring a necessary amount of an aqueous metal complex Solution into a reaction vessel during the grain formation. Among these, preferred is a method comprising adding an aqueous solution of metal complex powder together with or without NaCl or KCl to the water-soluble halide solution.

In order to add the compound to the grain surface, a necessary amount of an aqueous metal complex solution may be charged into a reaction vessel immediately after the grain formation, during or after completion of the physical ripening, or at the time of chemical ripening.

As the iridium compound for use in the present invention, various compounds may be used, and examples thereof include hexachloroiridium, hexammineiridium, trioxalatciridium, hexacyanoiridium and pentachloronitrosyliridium. These iridium compounds are used in a dissolved form in water or other appropriate solvent, where a method commonly used for stabilizing the iridium compound solution may be applied, in which an aqueous hydrogen halide solution (e.g. hydrochloric acid, bromic acid, fluoric acid) or alkali halide (e.g KCl, NaCl, KBr, NaBr) is added. In place of using the water-soluble iridium, separate silver halide grains pre-doped with iridium may be added and dissolved at the time of preparation of silver halide. An amount of addition of the iridium compound is preferably from $1\times10^{-8}$ to $1\times10^{-3}$ mol per one mol of silver halide, and more preferably from $1\times10^{-7}$ to $5\times10^{-4}$ mol.

The silver halide grain for use in the present invention may further contain a metal atom such as cobalt, iron, nickel, chromium, palladium, platinum, gold, thallium, copper and lead. As for cobalt, iron, chromium and ruthenium compound, hexacyano metal complex is preferably used. Specific examples thereof include ferricyanate ion, ferrocyanate ion, hexacyanocobaltate ion, hexacyanochromate ion and hexacyanoruthenate ion, while not being limited thereto. The phase of the silver halide, in which the metal complex is contained, is not particularly limited, and the phase may be uniform or the metal complex may be contained in a higher concentration in the core portion or in the shell portion.

The above-described metal is used preferably in an amount of from $1\times10^{-9}$ to $1\times10^{-4}$ mol per one mol of silver halide. The metal may be added at the time of preparation of the grains through converting it into a metal salt in the form of simple salt, double salt or complex salt.

The photosensitive silver halide grain maybe desalted by water washing according to a method known in the art, such as noodle washing and flocculation, while no desalting being also allowable.

The silver halide emulsion for use in the present invention is preferably subjected to chemical sensitization. The chemical sensitization may be performed using a known method such as sulfur sensitization, selenium sensitization, tellurium sensitization or noble metal sensitization.

These sensitization method may be used individually or in any combination. When these sensitization methods are used in combination, preferable combinations include sulfur sensitization and gold sensitization; sulfur sensitization and selenium or tellurium sensitization; gold sensitization and selenium or tellurium sensitization; sulfur sensitization, selenium or tellurium sensitization and gold sensitization; sulfur, selenium and tellurium sensitizations; and sulfur, selenium, tellurium and gold sensitizations.

The sulfur sensitization preferably applied to the present invention is usually performed by adding a sulfur sensitizer and stirring the emulsion at a temperature as high as 40° C. or above for a predetermined time. The sulfur sensitizer may be a known compound and examples thereof include, in addition to the sulfur compound contained in gelatin, various sulfur compounds such as thiosulfates, thioureas, thiazoles and rhodanines, among which thiosulfate and thiourea being preferable. Although an amount of addition of the sulfur sensitizer varies depending upon various conditions such as pH, temperature and grain size of silver halide at the time of chemical ripening, it is preferably from $10^{-7}$ to $10^{-2}$ mol per one mol of silver halide, and more preferably from $10^{-5}$ to $10^{-3}$ mol.

The gold sensitizer used for the gold sensitization of the silver halide emulsion used in the present invention may have an oxidation number of gold of either 1 or 3, and may be a gold compound commonly used as a gold sensitizer. Examples thereof include chloroauric acid, potassium chloroaurate, auric trichloride, potassium auric thiocyanate, potassium iodoaurate, tetracyanoauric acid, ammonium aurothiocyanate, and pyridyltrichloro gold.

An amount of addition of the gold sensitizer varies depending on various conditions, where it is generally $1\times10^{-7}$ to $1\times10^{-3}$ mol per one mol of silver halide, and more preferably $1\times10^{-7}$ to $5\times10^{-4}$ mol.

The selenium sensitizer for use in the present invention may be a known selenium compound. The selenium sensitization is usually performed by adding a labile and/or non-labile selenium compound and stirring the emulsion at a temperature as high as 40° C. or above for a predetermined time. Examples of the labile selenium compound include those described in JP-B-44-15748, JP-B-43-13489, JP-A-4-25832, JP-A-4-109240 and JP-A-4-324855. Among these, particularly preferred are those expressed by formulae (VIII) and (IX) of JP-A-4-324855.

The tellurium sensitizer for use in the present invention is a compound capable of producing silver telluride, presumably serve as a sensitization nucleus, on the surface or inside of silver halide grain. The rate of the formation of silver telluride in a silver halide emulsion can be examined according to a method described in JP-A-5-313284. Example of the tellurium sensitizer include diacyl tellurides, bis(oxycarbonyl) tellurides, bis(carbamoyl) tellurides, diacyl ditellurides, bis(oxycarbonyl) ditellurides, bis(carbamoyl) ditellurides, compounds having a P—Te bond, tellurocarboxylates, Te-organyltellurocarboxylic esters, di(poly)tellurides, tellurides, tellurols, telluroacetals, tellurosulfonates, compounds having a P—Te bond, Te-containing heterocycles, tellurocarbonyl compounds, inorganic tellurium compounds and colloidal tellurium. Specific examples thereof include the compounds described in U.S. Pat. Nos. 1,623,499, 3,320,069 and 3,772,031; British Patents No. 235,211, No. 1,121,496, No. 1,295,462 and No. 1,396,696; Canadian Patent No. 800,958; JP-A-4-204640, JP-A-4-271341, JP-A-4-333043, JP-A-5-303157; J. Chem. Soc. Chem. Commun., 635 (1980), ibid., 1102 (1979); ibid., 645 (1979); J. Chem. Soc. Perkin. Trans., 1, 2191 (1980); S. Patai (compiler), The Chemistry of Organic Selenium and Tellurium Compounds, Vol. 1 (1986); and ibid., Vol. 2 (1987). The compounds expressed by formulae (II), (III) and (IV) of JP-A-5-313284 are particularly preferred.

An amount of the selenium or tellurium sensitizer used in the present invention varies depending on silver halide grains used or chemical ripening conditions. However, it is generally from $10^{-8}$ to $10^{-2}$ mol per one mol of silver halide, preferably on the order of from $10^{-7}$ to $10^{-3}$ mol. The conditions for chemical sensitization in the present invention are not particularly restricted. However, in general, pH is from 5 to 8; pAg is from 6 to 11, preferably from 7 to 10; and temperature is from 40 to 95° C., preferably from 45 to 85° C.

As for the silver halide emulsion for use in the present invention, production or physical ripening process for the silver halide grain may be performed under the presence of cadmium salt, sulfite, lead salt or thallium salt.

In the present invention, reductive sensitization may be adoptable. Specific examples of the compound used in the reductive sensitization include ascorbic acid, thiourea dioxide, stannous chloride, aminoiminomethanesulfinic acid, hydrazine derivative, borane compound, silane compound and polyamine compound. The reductive sensitization may be performed by ripening the grains while keeping the emulsion at pH 7 or above, or at pAg 8.3 or below. Also, the reductive sensitization may be performed by introducing a single addition portion of silver ion during the formation of the grains.

To the silver halide emulsion for use in the present invention, thiosulfonic acid compound may be added by the method described in European Laid-Open Patent Publication No. 293917A.

In the recording material used for the present invention, a single kind of silver halide emulsion may be used, or two or more kinds of silver halide emulsions (for example, those differ in the average grain size, halogen composition, crystal habit or chemical sensitization conditions) may be used in combination. Using a two or more kinds of photosensitive silver halide differ in sensitivity allows gradation control.

Related technologies are disclosed, for example, in JP-A-57-119341, JP-A-53-106125, JP-A-47-3929, JP-A-48-55730, JP-A-46-5187, JP-A-50-73627 and JP-A-57-150841. Sensitivity difference among individual emulsions is preferably 0.2 logE or larger An amount of addition of the photosensitive silver halide as expressed by an amount of silver per 1 $m^2$ of a photosensitive material is preferably 0.03 to 0.6 $g/m^2$, more preferably 0.05 to 0.4 $g/m^2$, and most preferably 0.1 to 0.4 $g/m^2$; and that expressed by an amount relative to 1 mol of the organic silver salt is preferably 0.01 to 0.5 mol, more preferably from 0.02 to 0.3 mol, and still more preferably from 0.03 to 0.25 mol.

Methods for mixing photosensitive silver halide and organic silver salt separately prepared include such that mixing, after completion of the individual preparation, the silver halide grains and the organic silver salt in a high-speed stirrer, ball mill, sand mill, colloid mill, vibrating mill, homogenizer or the like; and such that mixing, at any timing during preparation of the organic silver salt, already-finished photosensitive silver halide to prepare the organic silver salt; while not being limited thereto as far as sufficient effects of the present invention are obtained.

A preferable timing for adding the silver halide to the coating liquid for image recording layer resides in a period from 180 minutes before to immediately before the coating, and more preferably from 60 minutes before to 10 seconds before. There is no specific limitation on method or conditions for the mixing provided that sufficient effects of the present invention will be obtained. Specific examples of the method include such that using a tank devised so that an average retention time estimated based on the addition flow rate and feed volume to a coater is adjusted to a desired value; and such that using a static mixer described in Chapter 8 of "Ekitai Kongo Gijutsu (Liquid Mixing Technology)" by N. Harnby, M. F. Edwards, and A. W. Nienow, translated by Koji Takahashi, published by Nikkan Kogyo Shinbun-sha (1989).

For the case that the organic silver salt-containing layer is formed by coating and drying the coating liquid, 30 wt % or more of the solvent of which being composed of water, the performance can further be improved if a binder contained in the organic silver salt-containing layer is soluble or dispersible into water-base solvent (aqueous solvent) and in particular comprises a polymer latex having an equilibrium moisture content of 2 wt % or less at 25° C. and relative humidity (RH) of 60%. Most preferable embodiment relates to a coating liquid prepared so as to attain an ionic conductivity of 2.5 mS/cm or less, which can be prepared, for example, by a method such that purifying a synthesized polymer using a separation functional membrane.

The water-base solvent described herein capable of dissolving or dispersing the polymer refers to water or mixed solvent comprising water and 70 wt % or less of water-miscible organic solvent. Examples of the water-miscible solvent include alcohols such as methanol, ethanol and propanol; Cellosolves such as Methyl Cellosolve, Ethyl Cellosolve and Butyl Cellosolve; ethyl acetate and dimethylformamide.

The term "water-base solvent" is also used herein to express a system in which polymer is not solubilized in a thermodynamic sense but exists in a dispersed form.

"The equilibrium moisture content at 25° C., 60%RH" is expressed by an equation such as equilibrium moisture content at 25° C., 60%RH=[(W1−W0)/W0]×100 (wt %) where, W1 represents polymer weight under humidity conditioning equilibrium in an environment of 25° C. and 60%RH, and W0 represents polymer weight under bone dry equilibrium. Definition and measurement method of water content can be referred to the description of "Kobunshi Zairyo Shiken-ho (Test Methods for Polymer Materials)" in the series of "Kobunshi Kogaku Koza 14 (Polymer Engineering Course 14)", edited by Polymer Society, published by Chijin Shokan.

An equilibrium moisture content at 25° C., 60%RH of the binder polymer used in the present invention is preferably 2 wt % or less, more preferably 0.01 to 1.5 wt %, and still more preferably 0.02 to 1 wt %.

Quite preferable in the present invention is a polymer dispersible in the water-base solvent.

Possible dispersion forms include such that microparticles of solid polymer are dispersed to form a latex, and such that polymer molecules are dispersed in a molecular state or form micells, either of which being preferable.

In a preferred embodiment of the present invention, preferably used are hydrophobic polymers such as acrylic resin, polyester resin, rubber-base resin (for example, SBR resin), polyurethane resin, vinyl chloride resin, vinyl acetate resin, vinylidene chloride resin and polyolefin resin. The polymer may be a straight-chained polymer, a branched polymer or a cross-linked polymer. The polymer may be a so-called homopolymer consisting of a single kind of monomer or may be a copolymer consisting of two or more kinds of monomers. Both of random copolymer and blocks copolymer are allowable as the copolymer. The polymer preferably has a number average molecular weight of from 5,000 to 1,000,000, and more preferably from 10,000 to 200,000. Too small molecular weight will result in poor mechanical strength of the emulsion layer, whereas too large in undesirable film-forming property.

The "water-base solvent" refers to a dispersion medium such that 30 wt % of the composition of which being composed of water. Any style of dispersion, such as emulsified dispersion, micellar dispersion, and molecular dispersion of polymer having in the molecule a hydrophilic portion, is allowable, and most preferable style can be found in latex.

Preferable examples of the polymer latex are listed below, in which polymers are expressed with source monomers, and numerals in the parentheses denote contents in wt % and the molecular weights represent number average molecular weights:

P-1; latex expressed as -MMA(70)-EA(27)-MAA(3)-(M.W. 37,000)

P-2; latex expressed as -MMA(70)-2EHA(20)-St(5)-AA(5)-(M.W. 40,000)

P-3; latex expressed as -St(50)-Bu(47)-MAA(3)-(M.W. 45,000)

P-4; latex expressed as -St(68)-Bu(29)-AA(3)-(M.W. 60,000)

P-5; latex expressed as -St(70)-Bu(27)-IA(3)-(M.W. 120,000)

P-6; latex expressed as -St(75)-Bu(24)-AA(1)-(M.W. 108,000)

P-7; latex expressed as -St(60)-Bu(35)-DVB(3)-MAA(2)-(M.W. 150,000)

P-8; latex expressed as -St(70)-Bu(25)-DVB(2)-AA(3)-(M.W. 280,000)

P-9; latex expressed as -VC(50)-MMA(20)-EA(20)-AN(5)-AA(5)-(M.W. 80,000)

P-10; latex expressed as -VDC(85)-MMA(5)-EA(5)-MAA(5)-(M.W. 67,000)

P-11; latex expressed as -Et(90)-MAA(10)-(M.W. 12,000)

P-12; latex expressed as -St(70)-2EHA(27)-AA(3)-(M.W. 130,000)

P-13; latex expressed as -MMA(63)-EA(35)-AA(2)-(M.W. 33,000)

The abbreviations in the above structures correspond with monomers as follows: MMA=methyl methacrylate, EA=ethyl acrylate, MAA=methacrylic acid, 2ENA=2-ethylhexyl acrylate, St=styrene, Bu=butadiene, AA=acrylic acid, DVB=divinylbenzene, VC=vinyl chloide, AN=acrylonitrile, VDC=vinylidene chloride, Et=ethylene, and IA=itaconic acid.

Such polymers are also commercially available, which include acrylic resins such as CEBIAN A-4635, 46583 and 4601 (all produced by Dicel Kagaku Kogyo K.K.) and Nipol Lx811, 814, 821, 820, 857 (all produced by Nippon Zeon K.K.); polyester resins such as FINETEX ES650, 611, 675, 850 (all produced by Dai-Nippon Ink & Chemicals, Inc.), WD-size and WMS (both produced by Eastman Chemical); polyurethane resins such as HYDRAN AP10, 20, 30, 40 (all produced by Dai-Nippon Ink & Chemicals, Inc.); rubber-based resins such as LACSTAR 7310K, 3307B, 4700H, 7132C (all produced by Dai-Nippon Ink & Chemicals, Inc.), Nipol Lx416, 410, 438C and 2507 (all produced by Nippon Zeon K.K.); vinyl chloride resins such as G351, G576 (both produced by Nippon Zeon K.K.); vinylidene chloride resins such as L502, L513 (both produced by Asahi Chemical Industry Co., Ltd.); and olefin resins such as CHEMIPEARL S120 and SA100 (both produced by Mitsui Chemical Co., Ltd.).

These polymers may be used individually or, as required, as a blend of two or more thereof.

A latex of styrene-butadiene copolymer is in particular preferable as the polymer latex used in the present invention. A weight ratio of styrene monomer unit and butadiene monomer unit in the styrene-butadiene copolymer is preferably 40:60 to 95:5. The styrene monomer unit and butadiene monomer unit preferably account for 60 to 99 wt % of the copolymer. A preferable range for the molecular weight thereof is the same as described previously.

The latex of the styrene-butadiene copolymer preferably used in the present invention is typified as P-3 to P-8 listed above and commercially available LACSTAR-3307B, 7132C, and Nipol Lx416.

The organic silver salt-containing layer of the thermally processed image forming material of the present invention can optionally be added with hydrophilic polymer such as gelatin, polyvinyl alcohol, methyl cellulose, and hydroxypropyl cellulose. An amount of addition of these hydrophilic polymers is preferably 30 wt % or less of the total binder, and preferably 20 wt % or less.

The organic silver salt-containing layer (i.e image recording layer) in the present invention is preferably formed using the polymer latex. A content of the binder in the organic silver salt-containing layer, expressed by a weight ratio of the total binder and the organic silver salt, is preferably 1/10 to 10/1, and more preferably 1/5 to 4/1.

For the case that such organic silver salt-containing layer is a photosensitive layer (emulsion layer) containing a photosensitive silver halide as a photosensitive silver salt, the weight ratio of the total binder and the silver halide is preferably 400 to 5, and more preferably 200 to 10.

An amount of the total binder of the image-recording layer is preferably 0.2 to 30 g/m$^2$, and more preferably 1 to 15 g/m$^2$. The image-recording layer may be added with a cross-linking agent for crosslinking or a surfactant for improving coating property.

In the present invention, the solvent (herein for simplicity, the solvent and dispersoid are inclusively termed as "solvent") is preferably a water-base solvent containing 30 wt % or more thereof of water. Possible component of the coating liquid other than water may be a water-miscible organic solvent such as methanol, ethanol, isopropanol, Methyl Cellosolve, Ethyl Cellosolve, dimethylformaide or ethyl acetate. Water content of the solvent for the coating liquid is preferably 50 wt % or above, and more preferably 70 wt % or above. Preferable examples of the solvent composition include water, water/methanol=90/10, water/methanol=70/30, water/methanol/dimethylformamide=80/15/5, water/methanol/Ethyl Cellosolve=85/10/5, water/methanol/isopropanol 85/10/5 (the numerals are in wt %).

The thermally processed image forming material of the present invention may contain a sensitizing dye. The sensitizing dye used in the present invention may arbitrarily be selected from those capable of spectrally sensitizing the silver halide particles at a desired wavelength region by adhering thereon. As such sensitizing dyes, usable are, for example, cyanine dyes, merocyanine dyes, complex cyanine dyes, complex merocyanine dyes, holopolar cyanine dyes, styryl dyes, hemicyanine dyes, oxonole dyes and hemioxonole dyes. Sensitizing dyes which-are usable in the present invention are described, for example, in Research Disclosure, Item 17643, IV-A (December, 1978, page 23), ibid. Item 1831X (August, 1978, page 437) and also in the references as cited therein. In particular, sensitizing dyes having a spectral sensitivity suitable for spectral characteristics of light sources of various laser imagers, scanners, image setters, process cameras and the like can advantageously be selected.

The sensitizing dyes are described in the paragraphs [0056] to [0066] or JP-A-10-62899, expressed by the general formula (II) of JP-A-10-186572, and described from line 38 on page 19 to line 35 on page 20 of European Laid-Open Patent Publication No. 0803764A1. The dyes particularly preferably used for the present invention include those having a carboxylic acid group (as disclosed in JP-3-163440, JP-A-6-301141, and U.S. Pat. No. 5,441,899); merocyanine dyes; polynuclear merocyanine dyes; and polynuclear cyanine dyes (as disclosed in JP-A-47-6329, JP-A-49-105524, JP-A-51-127719, JP-A-52-80829, JP-A-54-61517, JP-A-59-214846, JP-A-60-6750, JP-A-63-159841, JP-A-6-35109, JP-A-6-59381, JP-A-7-146537, JP-W-A-55-50111 (the code "JP-W-A" as used herein means an "international application published in Japanese for Japanese national phase"), British Patent No. 1,467,638, and U.S. Pat. No. 5,281,515); and those forming J-band (as disclosed in U.S. Pat. Nos. 5,510,236 and 3,871,887 (Example 5), JP-A-2-96131 and JP-A-59-48753).

These sensitizing dyes may be used either individually or in combination of two or more thereof. The combination of sensitizing dyes is often used for the purpose of supersensitization. In combination with the sensitizing dye, a dye which itself has no spectral sensitization effect, or a material which absorbs substantially no visible light but exhibits supersensitization may be incorporated into the emulsion. Useful sensitizing dyes, combinations of dyes which exhibit supersensitization, and materials which show supersensitization are described in Research Disclosure, Vol. 176, 17643, page 23, Item IV-J (December, 1978), JP-B-49-25500 and JP-B-43-4933, JP-A-59-19032 and JP-A-59-192242, and the like.

The sensitizing dye may be added to the silver halide emulsion by dispersing it directly in the emulsion or may be added to the emulsion after dissolving it in a solvent such as water, methanol, ethanol, propanol, acetone, Methyl Cellosolve, 2,2,3,3-tetrafluoropropanol, 2,2,2-trifluoroethanol, 3-methoxy-1-propanol, 3-methoxy-1-butanol, 1-methoxy-2-propanol and N,N-dimethylformamide; these solvents being used solely or by mixing.

Furthermore, the sensitizing dye may be added using a method disclosed in U.S. Pat. No. 3,469,987 by which the dye is dissolved in a volatile organic solvent, the obtained solution is then dispersed in water or hydrophilic colloid, and the obtained dispersion is added to the emulsion; methods disclosed in JP-B-44-23389, JP-B-44-27555 and JP-B-57-22091 by which the dye is dissolved in an acid, and then the obtained solution is added to the emulsion as it were or in the form of aqueous solution under the presence of acid or base; methods disclosed in U.S. Pat. Nos. 3,822,135 and 4,006,025 by which the dye, under the presence of surfactant, in a form of aqueous solution or colloid dispersion is added to the emulsion; methods disclosed in JP-A-53-102733 and JP-A-58-105141 by which the dye is dispersed directly in hydrophilic colloid and the obtained dispersion is added to the emulsion; or a method disclosed in JP-A-51-74624 by which the dye is dissolved using a compound capable of red shifting and the obtained solution is added to the emulsion. An ultrasonic wave may also be used in dissolving the dye.

In the preparation of the emulsion, the sensitizing dye may be added in any process steps as far as efficiency of which ever authorized. For example, in the grain formation process of silver halide and/or before desalting, or during the desalting process and/or the time period from desalting up to the initiation of chemical ripening, as disclosed in U.S. Pat. Nos. 2,735,766, 3,628,960, 4,183,756 and 4,225,666, JP-A-58-184142 and JP-A-60-196749, or immediately before or during the chemical ripening process, or in the time period after chemical ripening up to coating, as disclosed in JP-A-52-113920. Furthermore, as disclosed in U.S. Pat. No. 4,225,666 and JP-A-58-7629, a single kind of compound per se may be added in parts or the compound in combination with another compound having a different structure may be added in parts, for example, one part is added during grain formation and another part is added during or after the chemical ripening; or one part is added before or during the chemical ripening and another part is added after completion of the chemical ripening. When the compound is added in parts, the compound or combination of the compound added in parts may be altered for each addition process. Preferable addition is effected in a time period between the desalting and coating, and more preferably effected following the desalting and before starting the chemical ripening.

The amount of the sensitizing dye used in the present invention may be selected according to the performance such as sensitivity or fog; where it is preferably from $10^{-6}$ to 1 mol per one mol of silver halide in the photosensitive layer, and more preferably from $10^{-4}$ to $10^{-1}$ mol.

The silver halide emulsion and/or organic silver salt for use in the present invention can successfully be prevented, by addition of antifoggant, stabilizer or stabilizer precursor, from additional fogging and from lowered sensitivity during the stock storage. Appropriate examples of antifoggants, stabilizers and stabilizer precursors, available individually or in combination, include those described in paragraph [0070] of JP-A-10-62899 and from line 57 on page 20 to line 7 on page 21 of European Laid-open Patent Publication No. 0803764A1.

The antifoggant which is preferably used in the present invention is organic halide, and the typical compounds are disclosed in JP-A-50-119624, JP-A-50-120328, JP-A-51-121332, JP-A-54-58022, JP-A-56-70543, JP-A-56-99335, JP-A-59-90842, JP-A-61-129642, JP-A-62-129845, JP-A-6-208191, JP-A-7-5621, JP-A-7-2781, JP-A-8-15809 JP-10-339934 and U.S. Pat. Nos. 5,340,712, 5,369,000 and 5,464,737. In particular preferable are compounds expressed by the general formula (II) as disclosed in JP-A-10-339934 (more specifically, tribromomethylnaphthylsulfone, tribromomethylphenylsulfone, tribromomethyl[4-(2,4,6-trimethylphenylsulfonyl)phenyl]sulfone, for example).

The antifoggant used in the present invention may be added in any form of solution, powder or solid microparticle dispersion. Dispersion of the solid microparticle is effected using a known pulverizing means (e.g. ball mill, vibrating ball mill, sand mill, colloid mill, jet mill and roller mill). It is also allowable, for solid microparticle dispersion, to use a dispersion aid such as anionic surfactant (for example, sodium triisopropylnaphthalenesulfonate as a mixture of isomers differed in the sites of substitution by three isopropyl groups).

While not being essential for implementing the present invention, it is advantageous in some cases to add a mercury (II) salt as an antifoggant to the emulsion layer. Preferred mercury(II) salts for this purpose are mercury acetate and mercury bromide. The amount of addition of mercury for use in the present invention is preferably from $10^{-9}$ to $10^{-3}$ mol per one mol of silver coated, and more preferably from $10^{-8}$ to $10^{-4}$ mol.

The thermally processed image forming material of the present invention may contain azolium salts or benzoic acids for improving the sensitivity and for preventing fog. Examples of azolium salts include those expressed by the general formula (XI) in JP-A-59-193447, those disclosed in JP-B-55-12581, and those expressed by the general formula (II) in JP-A-60-153039. Benzoic acid may be any type of benzoic acid derivatives, where preferred examples of the structure include those described in U.S. Pat. Nos. 4,784,939 and 4,152,160 and JP-A-9-329863, JP-A-9-329864 and JP-A-9-281637. Although the azolium salts or benzoic acids may be added to any portion of the image recording material, addition to a layer provided on the same side with the photosensitive layer is preferable, and to an organic-silver-salt-containing layer is more preferable. The azolium salts or benzoic acids may be added at any step during the preparation of the coating liquid. In the case of addition to the organic-silver-salt-containing layer, they may be added at any step within a period from the preparation of the organic silver salt to the preparation of the coating liquid, where addition in a period following the preparation of the organic silver salt and immediately before the coating is preferable. The azolium salts or benzoic acids may be added in any form of solution, powder or solid microparticle dispersion. It is also allowable to add them in a form of mixed solution containing other additives such as a sensitizing dye, reducing agent and color toner. An amount of addition of the azolium salts or benzoic acids can arbitrarily set, where a preferable range being from $1\times10^{-6}$ to 2 mol, inclusive, per one mol of silver, and more preferably from $1\times10^{-3}$ to 0.5 mol, inclusive.

The thermally processed image forming material of the present invention may contain mercapto compound, disulfide compound or thione compound so as to control the development by inhibiting or accelerating thereof, to improve the spectral sensitization efficiency, or to improve the storage stability before and after the development.

Such mercapto compound, disulfide compound and thione compound are disclosed in the paragraphs [0067] to [0069] of JP-A-10-62899, expressed by the general formula (I) and specifically described in the paragraphs [0033] to [0052] of JP-A-10-186572, and described in lines 36 to 56 on page 20 of European Laid-Open Patent Publication No. 0803764A1. Among these, particularly preferable are mercapto-substituted heteroaromatic compounds such as 2-mercaptobenzimidazole, 2-mercapto-5-methylbenzimidazole, 2-mercaptobenzoxazole, 2-mercaptobenzothiazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, 2-mercapto-4-phenyloxazole, and 3-mercapto-4-phenyl-5-heptyl-1,2,4-triazole.

An amount of the addition, into the emulsion layer, of the mercapto compounds is preferably from 0.001 to 1.0 mol per one mol of silver, more preferably from 0.01 to 0.3 mol.

While dicarboxylic acid is used in the present invention, preferable is using other additives known as a color toner other than dicarboxylic acid, since they may successfully raise the optical density. These color toner may be advantageous in some cases also in forming a monotone silver image. The color toner is preferably contained in elsewhere on the side having the image recording layer in an amount of 0.1 to 50 mol % per one mol of silver, and more preferably 0.5 to 20 mol %. The color toner may be a so-called precursor which is derived to effectively exhibit its function only at the time of development.

Such color toners are described in the paragraphs [0054] to [0055] of JP-A-10-62899, and in lines 23 to 48 on page 21 of European Laid-Open Patent Publication No. 0803764A1. Examples of the color toner include phthalimides such as phthalimide; phthalazinone derivatives and metal salts or ammonium salts thereof, such as 4-(1-naphthyl)phthalazinone, 6-chlorophthalazinone, 5,7-dimethoxyphthalazinone or 2,3-dihydro-1,4-phthalazinedione; phthalhydrazides such as phthalhydrazide; phthalazine derivatives such as 4-(1-naphthyl)phthalazine, 6-isopropylphthalazine, 6-tert-butylphthalazine, 6-chlorophthalazine, 5,7-dimethoxyphthalazine, and 2,3-dihydrophthalazine); quinazolinones such as quinazolinone, quinazoline and 2,4-thiazolidinedione; and naphthalimides such as N-hydroxy-1,8-naphthalimide.

The color toner may be added in any form of solution, powder or solid microparticle dispersion. Dispersion of the solid microparticle is effected using a known pulverizing means (e.g. ball mill, vibrating ball mill, sand mill, colloid mill, jet mill and roller mill). A dispersion aid may be available for dispersing the solid microparticle.

The color toner can be included in the photosensitive layer or non-photosensitive layer, and in the image recording layer or non-recordable layer, preferably in the photosensitive layer and image recording layer. For the case of inclusion in the image recording layer or photosensitive layer, it is preferable to add the color toner in a form of solid microparticle dispersion from a viewpoint of raising the sensitivity without increasing the fog. When used in a form of solid microparticle dispersion, the color toner is preferably a compound substituted with a branched alkyl group from a viewpoint of improving the time-dependent property of the image recording material.

The color toner is preferably contained in elsewhere on the side having the thermographic recording layer or photosensitive layer in an amount of 1 to 2000 mg/m$^2$, and more preferably 30 to 1000 mg/m$^2$.

The image recording layer (or photosensitive layer) in the present invention may contain a plasticizer or lubricant, and examples thereof include polyhydric alcohols (for example, glycerin and diol described in U.S. Pat. Nos. 2,960,404); fatty acid or ester described in U.S. Pat. Nos. 2,588,765 and 3,121,060; and silicone resin described in British Patent No. 955,061.

An ultrahigh contrast agent for producing an image with an ultrahigh contrast may be used in the present invention. Examples of the ultrahigh contrast agent include hydrazine derivatives disclosed in U.S. Pat. Nos. 5,464,738, 5,496,695, 6,512,411, and 5,536,622, JP-A-10-10672, JP-A-10-62898, JP-A-10-31282, JP-A-9-319048, JP-A-9-304870 and JP-A-9-304872; compound having a quaternary nitrogen atom disclosed in JP-A-9-274274; and acrylonitrile compounds disclosed in U.S. Pat. No. 5,545,515. Specific examples of such compounds are exemplified as Compounds 1 to 10 of the above described U.S. Pat. No. 5,464,738; Compounds H-1 to H-28 described in U.S. Pat. No. 5,496,695; Compounds I-1 to I-86 of JP-A-10-10672; Compounds H-1 to H-62 of JP-A-10-62898; Compounds 1-1 to 1-21 of JP-A-10-31282; Compounds 1 to 50 of JP-A-9-304870; Compounds 1 to 40 of JP-A-9-304872; Compounds P-1 to P-26 and Compounds T-1 to T-18 of JP-A-9-274274; and Compounds CN-1 to CN-13 of U.S. Pat. No. 5,545,515.

In the present invention, a contrast accelerator may be used in combination with the above-described ultrahigh contrast agent so as to produce an ultrahigh contrast image. Examples thereof include amine compounds described in U.S. Pat. No. 5,545,505, specifically, AM-1 to AM-5; hydroxamic acids described in U.S Pat. No. 5,545,507, specifically, HA-1 to HA-11; acrylonitriles described in U.S. Pat. No. 5,545,507, specifically, CN-1 to CN-13; hydrazine compounds described in U.S. Pat. No. 5,558,983, specifically, CA-1 to CA-6; and onium salts described in JP-A-9-297368, specifically, A-1 to A-42, B-1 to B-27 and C-1 to C-14.

Synthetic method, addition method and amount of addition of these ultrahigh contrast agents and contrast accelerators are same as those described in the above-cited patent publications.

The image recording material of the present invention may have a surface protective layer for preventing adhesion of the image-forming layer.

While any kind of polymer is available for a binder contained in the surface protective layer, a polymer having carboxylic acid residues is preferable. The polymers having carboxylic acid residues described herein include natural polymers (e.g. gelatin, alginic acid); modified natural polymers (e.g. carboxymethylcellulose, phthalized gelatin); and synthetic polymers (e.g. polymethacrylate, polyacrylate, polyalkylmethacrylate/acrylate copolymer, polystyrene/polymethacrylate copolymer). Contents of the carboxylic acid residues in these polymers are preferably $1\times10^{-2}$ to 1.4 mol per 100 g of polymer. The carboxylic acid residues can form salts with, for example, alkali metal ion, alkali earth metal ion and organic cation. Gelatin is most preferable.

It is also preferable to use polyvinyl alcohol (PVA) as a binder for the surface protective layer, and examples of which include a fully saponified PVA-105 [PVA content≧94.0 wt %, saponification ratio=98.5±0.5 mol %, sodium acetate content≦1.5 wt %, volatile matter content≦5.0 wt %, viscosity (4 wt %, 20° C.)=5.6±0.4 cps];

partially saponified PVA-205 [PVA content≧94.0 wt %, saponification ratio=88.0±1.5 mol %, sodium acetate content=1.0 wt %, volatile matter content=5.0 wt %, viscosity (4 wt %, 20° C.)=5.0±0.4 cps]; and modified polyvinyl alcohol named MP-102, MP-202, MP-203, R-1130 and R-2105 (all of which being product names by Kuraray Co., Ltd.)

An amount of coating of polyvinyl alcohol (per 1 $m^2$ of the support) for the protective layer (per one layer) is preferably 0.3 to 4.0 $g/m^2$, and more preferably 0.3 to 2.0 $g/m^2$.

Any kind of adhesion preventive material is available for the surface protective layer in the present invention. Examples of the adhesion preventive material include wax; silica particle; styrene-containing elastomeric block copolymer (e.g. styrene-butadiene-styrene, styrene-isoprene-styrene); cellulose acetate; cellulose acetate butylate; cellulose propionate; and mixtures thereof. The surface protective layer may also contain a crosslinking agent for crosslinking, and surfactant for improving coating property.

The image-forming layer and the protective layer thereof in the present invention may contain a light absorbing substance and filter dye as described in U.S. Pat. Nos. 3,253,921, 2,274,782, 2,527,583 and 2,956,879. It is also allowable to dye through mordanting as described, for example, in U.S. Pat. No. 3,282,699. The filter dye is preferably used in an amount so as to attain an absorbance of 0.1 to 3, and more preferably 0.2 to 1.5.

The image recording layer at the protective layer thereof may contain a matting agent, and examples thereof include starch, titanium dioxide, zinc oxide, silica and polymer beads containing such beads disclosed in U.S. Pat. Nos. 2,922,101 and 2,701,245.

Preparation temperature of the coating liquid for the image recording layer used for the present invention is preferably 30 to 65° C., more preferably 35 to 60° C., and still more preferably 35 to 55° C. It is also preferable to keep the temperature of the coating liquid for the image recording layer at 30 to 65° C. immediately after the addition of the polymer latex. The reducing agent and organic silver salt are preferably mixed with each other before the polymer latex is added.

The organic acid-containing fluid and the coating liquid for the image recording layer are preferably a so-called thixotropic fluid. Thixotropy refers to a property such that the viscosity decreases as the shearing velocity increases. While any type of apparatus is the available for viscosity measurement, preferable measurement can be performed at 25° C. using RFS Fluid Spectrometer manufactured by Rheometric Far East Inc. In the present invention, the viscosity of the organic acid-containing fluid or the coating liquid for the image recording layer under a shearing velocity of 0.1 $S^{-1}$ is preferably 400 to 100,000 mPa·s, and more preferably 500 to 20,000 mPa·s. Such viscosity under a shearing velocity of 1000 $S^{-1}$ is preferably 1 to 200 mPa·s, and more preferably 5 to 80 mPa·s.

There are known various system exerting thixotropy and can be found in "Koza—Reoroji (Rheology Course)" edited by Kobunshi Kanko-kai, and "Kobunshi Ratekkusu (Polymer Latex)" collaborated by Muroi and Morino. It is necessary for fluid to contain a large amount of solid microparticles for exerting thixotropy. Thixotropy can advantageously be enhanced by including a thickening linear polymer, increasing an aspect ratio of solid particle with an anisotropic shape, or using an alkali thickener or surfactant.

The heat-developable photographic emulsion used in the present invention forms on the support one or more layers. In the monolayer composition, the layer must contain organic silver salt, silver halide, reducing agent and binder, and may additionally contain color toner, coating aid and other auxiliary agents as an option. In the double-layer composition, a first emulsion layer (usually adjacent to the substrate) must contain an organic silver salt and a silver halide, and a second layer or both layer must contain some other components. Alternative double-layer composition may be allowable in which a single emulsion layer contains all components and a protective topcoat is provided thereon. A multicolor photothermographic material may have a structure such that a combination of the above-described two layers is provided for the respective colors, or, as described in U.S. Pat. No. 4,708,928, a structure such that a single layer contains all components. In the case of a multi-dye multi-color photothermographic material, the rerspective emulsion layers are generally kept away from each other by using a functional or non-functional barrier layer between the respective photosensitive layers as described in U.S. Pat. No. 4,460,681.

The image recording layer (photosensitive layer) in the present invention may contain a dye or pigment of various types so as to improve the color tone or prevent the irradiation. This is described in detail in WO 98/36322. Examples of dyes and pigments suitable for the image recording layer include anthraquinone dye, azomethine dye, indoaniline dye, azo dye, anthraquinon-base indanthrone dye (for example, C.I. Pigment Blue 60), phthalocyanine dye (for example, copper phthalocyanine such as C.I. Pigment Blue 15, and metal-free phthalocyanine such as C.I. Pigment Blue 16), dying lake pigment-base triarylcarbonyl pigment, indigo, and inorganic pigment (for example, ultramarine blue, cobalt blue). The dye may be added in any form of solution, emulsified product or solid microparticle dispersion or may be added in the state mordanted with a polymer mordant. The amount of such compounds used may be determined according to desired absorbance, and, in general, the compounds are preferably used in an amount of from $1\times10^{-6}$ to 1 g per 1 $m^2$ of the recording material.

In the present invention, an antihalation layer may be provided on the side more distant from the light source than the image recording layer (photosensitive layer). The antihalation layer preferably has a maximum absorbance of 0.3 to 2 in a desired wavelength range, preferably has an absorption of 0.5 to 2 at an exposure wavelength, and preferably has an absorption after processing of 0.001 to 0.5 in the visible wavelength region, and more preferably 0.001 to 0.3.

In the case when an antihalation dye is used in the present invention, the dye may be any compound so long as the compound has a defired absorption in a desired wavelength region, and the absorption in the visible wavelength region can sufficiently be reduced after the processing. While examples thereof include those described in the following patent publications, the present invention is by no means limited thereto: as a single dye, the compounds described in JP-A-59-56458, JP-A-2-216140, JP-A-7-13295, JP-A-7-11432, U.S. Pat. No. 5,380,635, JP-A-2-68539 (from page 13, left lower column, line 1 to page 14, left lower column, line 9) and JP-A-3-24539 (from page 14, left lower column to page 16, right lower column); and as a dye which is faded after the processing, the compounds described in JP-A-52-139136, JP-A-53-132334, JP-A-56-501480, JP-A-57-16060, JP-A-57-68831, JP-A-57-101835, JP-A-59-182436, JP-A-7-36145, JP-A-7-199409, JP-B-48-33692, JP-B-50-16648, JP-B-2-41734 and U.S. Pat. Nos. 4,088,497, 4,283,487, 4,548,896 and 5,187,049.

It is preferable in the present invention to add a fading dye and basic precursor to the non-recordable layer (non-photosensitive layer) to make it function as a filter layer or antihalation layer. The thermally processed image forming material generally has, in addition to the image recording layer, the non-recordable layer. The non-recordable layer can be classified by the arrangement thereof into (1) a protective layer provided on the image recording layer (on the side more distant from the support), (2) an intermediate layer provided between a plurality of the image recording layers or between the image recording layer and the protective layer, (3) an undercoat layer provided between the image recording layer and the support, and (4) a back layer provided on the opposite side of the image recording layer. The filter layer is provided to the image forming material as a layer classified as (1) or (2), whereas the antihalation layer is provided thereto as a layer classified as (3) or (4).

The fading dye and basic precursor are preferably added in the same non-recordable layer, where adding separately into the two adjacent non-recordable layers is allowable. A barrier layer can be provided between two non-recordable layers.

The fading dye may be added to the non-recordable layer in any form of solution, emulsified product or solid microparticle dispersion or may be added by adding polymer immersed material to the coating liquid for the non-recordable layer. It is also allowable to add the dye to the non-recordable layer using a polymer mordant. These methods of addition are the same as the general methods adding the dye to the thermally processed image forming material. Latex used for the polymer immersed material is described in U.S. Pat. No. 4,199,363, German Laid-Open Patent Publication Nos. 25,141,274 and 2,541,230, European Laid-Open Patent Publication No. 029,104 and JP-B-53-41091. An emulsifying method in which the dye is added into the polymer solubilized solution is disclosed in WO 88/00723.

An amount of addition of the fading dye is determined according to applications of the dye. In general, the fading dye is used in an amount affording an optical density (absorbance) measured at a target wavelength exceeding 0.1. The optical density is preferably 0.2 to 2. An amount of use of the dye to afford such optical density is approx. 0.001 to 1 g/m$^2$ in general, more preferably approx. 0.005 to 0.8 g/m$^2$, and still more preferably approx. 0.01 to 0.2 g/m$^2$.

Such fading of the dye makes the optical density suppressed to 0.1 or below. Two or more fading dyes may be used together for the heat-fading recording material or photothermographic material. Similarly, two or more basic precursors may be used together.

The photothermographic material of the present invention is preferably of a so-called single-sided type comprising a support having on one side thereof at least one photosensitive layer containing silver halide emulsion (preferably an image-forming layer) and on the other side thereof a back layer.

For the single-sided thermally processed image forming material in the present invention, a matting agent may be added to improve the transport property. The matting agent appears, in general, as organic or inorganic fine particles insoluble to water. Arbitrary matting agents are available, examples of which include organic matting agents disclosed in U.S. Pat. Nos. 1,939,213, 2,701,245, 2,322,037, 3,262,782, 3,539,344 and 3,767,448; and inorganic matting agents disclosed in U.S. Pat. Nos. 1,260,772, 2,192,241, 3,257,206, 3,370,951, 3,523,022 and 3,769,020; all of which being well known in the related art. More specifically, the organic compounds available as the matting agent include water-dispersible vinyl polymers such as potymethyl acrylate, polymethyl methacrylate, polyacrylonitrile, acrylonitrile-α-methylstyrene copolymer, polystyrene, styrene-divinylbenzene copolymer, polyvinyl acetate, polyethylene carbonate and polytetrafluoroethylene; cellulose derivatives such as methyl cellulose, cellulose acetate, and cellulose acetate propionate; starch derivatives such as carboxystarch, carboxynitrophenylstarch, and urea-formaldehyde-starch reaction product; gelatin hardened with a known hardening agent; and hardened gelatin in a form of fine capsulated hollow particle obtained by coacervate hardening. Preferable examples of the inorganic compounds include silicon dioxide, titanium dioxide, magnesium dioxide, aluminum oxide, barium sulfate, calcium carbonate, silver chloride desensitized by a known method, silver bromide similarly processed, glass and diatom earth. Different kinds of the matting agent may be combined for use as required. There are no special limitation on the size and morphology of the matting agent, and that having an arbitrary diameter is available. For implementing the present invention, it is preferable to use a matting agent with 0.1 to 30 μm diameter, and more preferably with an average diameter of 2 to 10 μm. Both of wide and narrow particle size distributions of the matting agent are allowable. Since the matting agent strongly affects the haze and surface gloss of the photosensitive material, the particle size, morphology and particle size distribution of which are preferably selected as required at the time of preparation of the matting agent, or sometimes by mixing two or more matting agents.

A coated amount of the matting agent per 1 m$^2$ of the image recording material is preferably 1 to 400 mg/m$^2$, and more preferably 5 to 300 mg/m$^2$.

While there is no special limitation on the degree of matting so long as stardust failure does not occur, the Bekk smoothness falls preferably within a range from 50 to 10,000 seconds, and more preferably 80 to 10,000 seconds.

The degree of matting of the back layer is preferably expressed as a Bekk smoothness of 10 to 1200 seconds, more preferably 30 to 700 seconds, and still more preferably 50 to 500 seconds.

In the present invention, the matting agent is preferably added to an outermost layer or a layer functions as the outermost layer of the recording material, or to a layer provided near the outer surface thereof, and in particular to a layer functions as a so-called protective layer.

The binder preferably applied to the back layer in the present invention is transparent or semi-transparent, colorless in general, and van be made of natural polymer, synthetic resin, polymer and copolymer, as well as other film-forming media such as gelatin, gum arabic, polyvinyl alcohol), hydroxyethylcellulose, cellulose acetate, cellulose acetate butylate, poly(vinylpyrrolidone), casein, starch, poly (acrylic acid), poly(methyl methacrylate), polylvinyl chloride), poly(methacrylic acid), copoly(styrene-maleic anhydride), copoly(styrene-acrylonitrile), copoly(styrene-butadiene), polyvinyl acetals (such as poly(vinylformal) and poly(vinylbutyral)), polyesters, polyurethanes, phenoxy resin, poly(vinylidene chloride), polyepoxides, polycarbonates, poly(vinyl acetate), cellulose esters and polyamides. The binder may also be formed by coating from water, organic solvent or emulsion.

In the present invention, the back layer preferably has a maximum absorbance of 0.3 to 2 in a desired wavelength range, more preferably 0.5 to 2, and preferably has an absorption after processing of 0.001 to 0.5 in the visible wavelength region, and more preferably 0.001 to 0.3. Examples of an antihalation dye are similar to those used fox the antihalation layer described above.

A backside resistive heating layer described in U.S. Pat. Nos. 4,460,681 and 4,374,921 may also be used in the thermally processed image forming material of the present invention.

In the present invention layers such as the image recording layer, protective layer and back layer each may contain a film hardening agent. Various method of use of the film hardening agent are described in "The Theory of the Photographic Process 4th Edition" by T. H. James, published by Macmillan Publishing Co., Inc. (1977), pages 77 to 87, and preferably used are polyvalent metal ion described in page 78 of this book; polyisocyanates described in U.S. Pat. No. 4,281,060 and JP-A-6-208193; epoxy compounds described, for example, in U.S. Pat. No. 4,791,042; and vinyl sulfone compounds described, for example, in JP-A-62-89048.

The film hardening agent is added in a form of solution, and preferable timing for adding thereof to the coating liquid for the protective layer resides in a period from 180 minutes before to immediately before the coating, and more preferably from 60 minutes before to 10 seconds before. There is no specific limitation on method or conditions for the mixing provided that sufficient effects of the present invention will be obtained. Specific examples of the method include such that using a tank devised so that an average retention time estimated based on the addition flow rate and feed volume to a coater is adjusted to a desired value; and such that using a static mixer described in Chapter 8 of "Ekitai Kongo Gijutsu (Liquid Mixing Technology)" by N. Harnby, M. F. Edwards, and A. W. Nienow, translated by Koji Takahashi, published by Nikkan Kogyo Shinbun-sha (1989).

Surfactants may preferably used in the present invention to improve the coating property and electric charging. Nonionic, anionic, cationic, fluorine-containing, and any other types of surfactants are properly available. More specifically, they are exemplified as fluorine-containing polymer surfactants disclosed, for example, in JP-A-62-170950 and U.S. Pat. No 5,380,644; fluorine-containing surfactants disclosed, for example, in JP-A-60-244945 and JP-A-63-188135; polysiloxane-base surfactants disclosed, for example, in U.S. Pat. No. 3,885,965; polyalkylene oxide disclosed, for example, in JP-A-6-301140; and anionic surfactants.

Examples of solvent available for the present invention can be found, for example, in "Shinpan Yozai Poketto Bukku (New Solvent Pocket Book)" published by OHM-sha (1994), while not being limited thereto. Solvents used for the present invention preferably have boiling points within a range from 40 to 180° C.

Examples of the solvents available for the present invention include hexane, cyclohexane, toluene, methanol, ethanol, isopropanol, acetone, methyl ethyl ketone, ethyl acetate, 1,1,1-trichloroethane, tetrahydrofuran, triethyamine, thiophene, trifluoroethanol, perfluoropentane, xylene, n-butanol, phenol, methyl isobutyl ketone, cyclohexanone, butyl acetate, diethyl carbonate, chlorobenzene, dibutyl ether, anisole, ethyleneglycol diethyl ether, N,N-dimethylformamide, morpholine, propane sultone, perfluorotributylamine and water.

The heat-developable photographic emulsion used in the present invention may generally be coated on a variety of supports. Typical supports include polyester film, undercoat polyester film, poly(ethylene terephthalate) film, poly (ethylene naphthalate) film, cellulose nitrate film, cellulose ester film, poly(vinyl acetal) film, polycarbonate film and related resin material, glass, paper and metal. Typically used are flexible materials such as baryta and/or partially acetylated paper support, and in particular paper support coated with α-olefin polymer; α-olefin polymer being such that having a carbon number of 2 to 10, such as polyethylene, polypropylene and ethylene-butene copolymer. Both of transparent and opaque supports are allowable, the former being more preferable. The transparent support may be colored with a blue dye (for example, Dye-1 described in Example of JP-A-8-240877).

The thermally processed image forming material of the present invention may have, for an antistatic or conduction promoting purpose, a layer containing or comprising soluble salts (e.g. chloride, nitrate); vapor-deposited metal; ionic polymers disclosed in U.S Pat. Nos. 2,861,056 and 3,206,312; and insoluble inorganic salts disclosed in U.S. Pat. No. 3,428,451.

The thermally processed image forming material of the present invention is preferably of monosheet type (such that capable of forming an image thereon without using other sheets such as an image receiving material).

The thermally processed image forming material of the present invention may be added with an antioxidant, stabilizer, plasticizer, ultraviolet absorbing agent and coating aid. These additives are added to either the image recording layer or non-recording layer, which can be referred to WO 98/36322, EP803764A1, JP-A-10-186567 and JP-A-10-18568.

The image recording layer in the present invention may contain a plasticizer or lubricant, and examples thereof include polyhydric alcohols (for example, glycerin and diol described in U.S. Pat. No. 2,960,404); fatty acid or ester described in U.S. Pat. Nos. 2,588,765 and 3,121,060; and silicone resin described in British Patent No. 955,061.

A method for obtaining a color image using the thermally processed image forming material of the present invention is described in JP-A-7-13295, from line 43 on page 10 in the left column to line 40 on page 11 in the left column. Stabilizing agents for color dye image are described in British Patent No. 1,326,889, U.S. Pat. Nos. 3,432,300, 3,698,909, 3,574,627, 3,573,050, 3,764,337 and 4,042,394.

The thermally processed image forming material in the present invention may be formed by a variety of coating processes, which include extrusion coating, slide coating, curtain coating, dip coating, knife coating, flow coating, and extrusion coating using A specific hopper described in U.S. Pat. No. 2,681,294. In particular, preferable are the extrusion coating and slide coating described together in "Liquid Film Coating" by Stephen F. Kistler and Petert M. Schweizer, published by Chapman and Hall (1997), pages 399 to 536, and the slide coating being more preferable. An exemplary shape of a slide coater used for the slide coating is shown in FIG. 11*b*.1 on page 427 in the above book. It is also allowable to simultaneously coat two or more layers as required according to the methods described in U.S. Pat. No. 2,761,791 and British Patent No. 837,095.

The thermally processed image forming material of the present invention may have additional layers such as dye accepting layer for accepting mobile dye image, opaque layer for effectuating reflective printing, protective top coat layer, and primer layer already known in the field of photothermal printing technology. It is preferable that the thermally processed image forming material of the present invention is capable of producing image solely by itself. That is, it is preferable that the functional layer necessary for forming image, such as image accepting layer, is not provided on the separate material.

Techniques applicable to the present invention are also found in European Laid-Open Patent Publication Nos.

EP803764A1 and EP883022A1, WO 98/36322, JP-A-9-281637, JP-A-9-297367, JP-A-9-304869, JP-A-9-311405, JP-A-9-329865, JP-A-10-10669, JP-A-10-62899, JP-A-10-69023, JP-A-10-186568, JP-A-10-90823, JP-A-10-171063, JP-A-10-186565, JP-A-10-186567, JP-A-10-186569, JP-A-10-186570, JP-A-10-186571, JP-A-10-186572, JP-A-10-197974, JP-A-10-197982, JP-A-10-197983, JP-A-10-197985, JP-A-10-197986, JP-A-10-197987, JP-A-10-207001, JP-A-10-207004, JP-A-10-221807, JP-A-10-282601, JP-A-10-288823, JP-A-10-288824, JP-A-10-307365, JP-A-10-312038, JP-A-10-339934, JP-A-11-7100, JP-A-11-15105, JP-A-11-24200, JP-A-11-24201 and JP-A-11-30832.

While the thermally processed image forming material of the present invention can be developed by any method, the development is generally practiced by elevating the temperature of the thermally processed image forming material after image-wise exposure Preferable development temperature is 0 to 250° C., and more preferably 100 to 140° C. Development time is preferably 1 to 180 seconds, more preferably 10 to 90 seconds, and still more preferably 10 to 40 seconds.

As for photothermographic system, the plate heater system is preferable. Heat development based on the plate heater system is preferably performed using an apparatus, disclosed in JP-A-9-229684 or JP-A-10-177610, such that obtaining a visible image by contacting a photothermographic material, in which a latent image has been produced, with a heating means at a heat-developing section; the heating means comprising a plate heater, a plurality of pressure rollers being opposingly placed along one plane of the plate heater, thereby allowing the photothermographic material to pass between the pressure rollers and plate heater to be heat-developed. It is preferable to divide the plate heater in two to six stages, and the temperature of the endmost portion of which is set lower by 1 to 10° C. than the other portions. Such technique is disclosed also in JP-A-54-30032, and can successfully discharge the moisture and organic solvent contained in the photothermographic material out of the system, and can prevent deformation of the support of the photothermographic material due to an abrupt heating thereof.

The thermally processed image forming material of the present invention may be light-exposed by any method but the light source for the exposure is preferably a laser light. The laser light for use in the present invention is preferably one from a gas laser ($Ar^+$, He—Ne), YAG laser, dye laser, semiconductor laser or the like. The semiconductor laser as combined with a second harmonic generation device may also be used. Preferable is a gas or semiconductor laser emitting red to infrared light.

While a single-mode laser is available as a laser light, the thermally processed image forming material of the present invention has a low haze at the time of exposure and is liable to incur generation of interference fringes. For preventing the generation of interference fringes, known technique such that entering a laser light obliquely with respect to the recording material disclosed in JP-A-5-113548, or such that using a multimode laser disclosed in International Patent Publication WO 95/31754 is preferably used.

The recording material of the present invention is preferably exposed so that loci of the laser lights are overlapped and the scanning lines are not visible as described in SPIE, Vol. 169, "Laser Printing", pages 116 to 128 (1979), JP-A-4-51043 and WO 95/31754.

Laser output is preferably 1 mW or above, more preferably 10 mW or above, and still more preferably 40 mW or above. A plurality of laser beams can be superposed. Beam spot diameter can be approx. 30 to 200 $\mu$m as expressed by an $1/e^2$ spot size of a Gaussian beam.

The thermally processed image forming material of the present invention preferably forms a black-and-white image based on silver image and is preferably used for photothermographic materials for medical diagnosis, industrial photograph, printing and COM. Obtained black-and-white image can, of course, be used for producing a dublicated image on duplication film MI-Dup for medical diagnosis manufactured by Fuji Photo Film Co., Ltd., and used as a mask for forming an image on films for return DO-175 and PDO-100 or an offset printing plate for printing manufactured by Fuji Photo Film Co., Ltd.

The present invention will be explained in more detail with reference to the following examples. However, amount of use, ratio, operation and so forth described hereinafter may properly be altered without departing from the spirit of the present invention. The scope of the present invention, therefore, is not limited to specific embodiments described below.

EXAMPLES

Formulae of the compounds used in the Example are shown below:

Compound 1

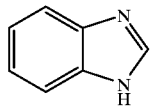

Compound 2

$K_3IrCl_8$

Compound 3

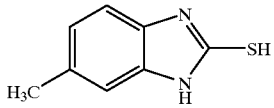

Compound 4

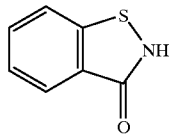

Compound 5

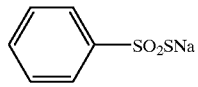

Compound 6

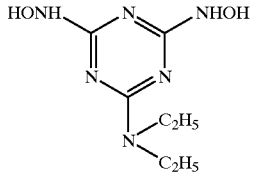

Compound 7

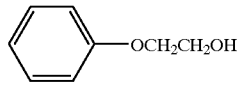

-continued

Compound 8

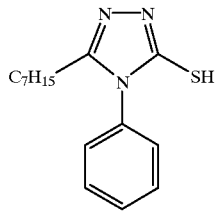

Compound 9

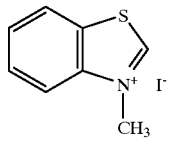

Spectral Sensitization Dye "A"

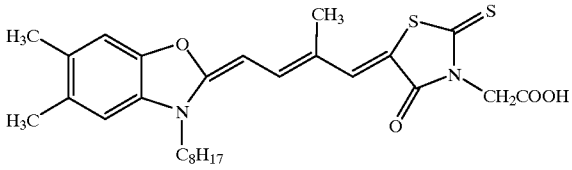

Tellurium Sensitizer "B"

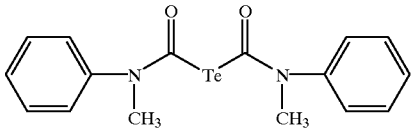

Basic Precursor Compound 11

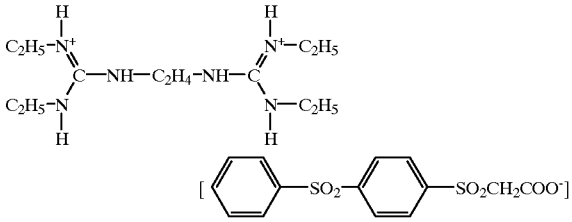

Compound 12

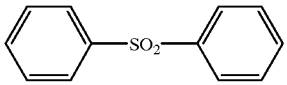

Cyanine Dye Compound 13

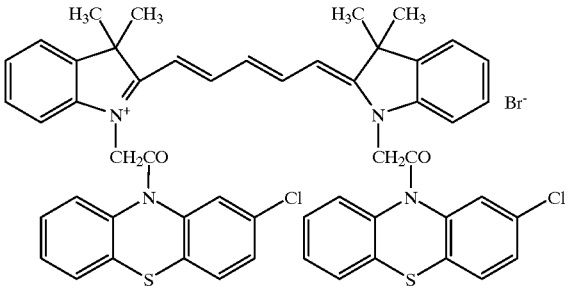

-continued

Blue Dye Compound 14

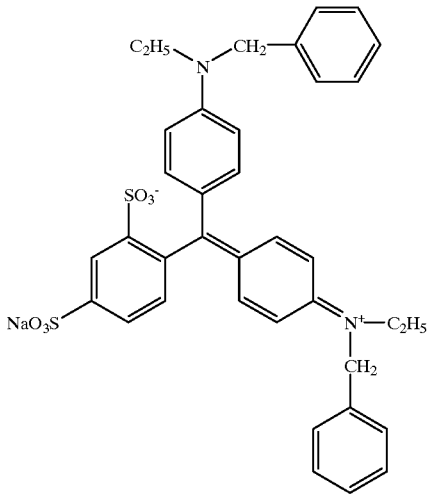

Example 1

1. Preparation of PET Support

PET with an intrinsic viscosity (IV) of 0.66 (measured in phenol/tetrachloroethane=6/4 (ratio by weight) at 25° C.) was obtained by the general procedures using terephthalic acid and ethylene glycol. The obtained PET was pelletized, dried at 130° C. for 4 hours, melted at 300° C., extruded from a T-die and rapidly cooled, to obtain a unstretched film so as to have a thickness of 120 $\mu$m after heat setting.

This film was longitudinally stretched 3.3 times using rollers different in the peripheral speed and then transversely stretched 4.5 times by a tenter at a temperature of 110° C. and 130° C., respectively. Subsequently, the film was heat-set at 240° C. for 20 seconds, and then relaxed by 4% in the transverse direction at the same temperature. Thereafter, the chucked part of the tenter was slitted off and the film was knurled at the both edges and then taken up at 4.8 kg/cm$^2$. Thus, a rolled support of 175 $\mu$m thick was prepared.

2. Surface Corona Treatment

Using a 6-kVA model of solid state corona treatment apparatus manufactured by Pillar Corporation, the both sides of the support were treated at 20 m/min under the room temperature. Referring to read values of current and voltage, it was confirmed that the support was treated at 0.375 kVA·minute/$^2$ with a treatment frequency of 9.6 kHz and a gap clearance between the electrode and dielectric roll of 1.6 mm.

3. Preparation of Undercoated Support (1) Preparation of Coating Liquid for the Undercoat Layer The three following coating liquids according to formulations (1) to (3) were prepared. Formulation (1) (for undercoat layer on the photosensitive layer side)

| | |
|---|---|
| PESRESIN A-515GB (30 wt % solution, manufactured by Takamatsu Oil & Fat Co., Ltd.) | 234 g |
| polyethylene glycol monononylphenyl ether (average number of ethylene oxide = 8.5), 10 wt % solution | 21.5 g |
| MP-1000 (polymer microparticle, average particle size = 0.4 $\mu$m, manufactured by Soken Chemical & Engineering Co., Ltd.) | 0.91 g |
| distilled water | 744 ml |

-continued

| Formulation (2) (for a first layer on the back plane) | |
|---|---|
| butadiene-styrene copolymer latex (solid content 40 wt %, ratio by weight of butadiene/styrene = 32/68) | 131 g |
| 2,4-dichloro-6-hydroxy-S-triazine sodium salt (8 wt % aqueous solution) | 5.1 g |
| sodium laurylbenzenesulfonate (1 wt % aqueous solution) | 10 ml |
| distilled water | 854 ml |
| **Formulation (3) (for a second layer on the back plane)** | |
| $SnO_2/SbO$ (ratio by weight = 9/1 average particle size = 0.038 μm, 17 wt % dispersion) | 84 g |
| gelatin (10% aqueous solution) | 89.2 g |
| METHOLLOSE TC-5 (2% aqueous solution, Manufactured by Shin-Etsu Chemical Co., Ltd.) | 8.6 g |
| MP-1000 (polymer microparticle, manufactured by Soken Chemical & Engineering Co., Ltd.) | 0.01 g |
| Sodium dodecylbenzenesulfonate (1 wt % aqueous solution) | 10 ml |
| PROXEL (manufactured by ICI Corporation) | 1 ml |
| distilled water | 805 ml |

(2) Preparation of Undercoated Support

Both sides of the biaxial stretched polyethylene terephthalate film of 175 μm thick were individually subjected to the corona discharge treatment, the undercoat coating liquid formulation (1) was then coated using a wire bar in a wet coated amount of 6.6 ml/$m^2$ on one plane (on which the photosensitive layer is to be formed) and was allowed to dry at 180° C. for 5 minutes, the undercoat coating liquid formulation (2) was then coated using a wire bar in a wet coated amount of 5.7 ml/$m^2$ on the rear plane (back plane) and was allowed to dry at 180° C. for 5 minutes, and the undercoat coating liquid formulation (2) was further coated using a wire bar in a wet coated amount of 5.7 ml/$m^2$ on the rear plane (back plane) and was allowed to dry at 180° C. for 6 minutes, to obtain an undercoated support 4. Preparation of Coating Liquid for the Back Layer (1) Preparation of Solid Microparticle Dispersion of Basic Precursor Sixty-four grams of Basic Precursor Compound 11, 28 g of Diphenylsulfone Compound 12, 10 g of DEMOL-N (surfactant manufactured by KAO Corporation), and 220 ml of distilled water were mixed, and the mixture was bead-dispersed using a sand mill (¼-gallon Sand Grinder Mill manufactured by AMNEX Corporation) to obtain a solid microparticle dispersion (a) of the basic precursor compound with an average particle size or 0.2 μm.

(2) Preparation of Solid Microparticle Dispersion of Dye

To 305 ml of distilled water, added were 9.6 g of the Cyanine Dye Compound 13 and 5.8 g of sodium p-dodecylbenzenesulfonate, and the mixture was then bead-dispersed using a sand mill (¼-gallon Sand Grinder Mill manufactured by AIMEX Corporation) to obtain a solid microparticle dispersion of the dye with an average particle size or 0.2 μm.

(3) Preparation of Coating Liquid for the Antihalation Layer

Seventeen grams of gelatin, 9.6 g of polyacrylamide, 70 g of the above-described solid microperticle dispersion (a) of the basic precursor, 56 g of the above-described solid microperticle dispersion of the dye, 1.5 g of polymethyl methacrylate microperticle (average particle size=6.5 μm), 2.2 g of sodium polyethylenesulfonate, 0.2 g of Blue Dye Compound 14 and 844 ml of water were mixed to prepare a coating liquid for the antihalation layer.

(4) Preparation of Coating Liquid for the Protective Layer on the Back Plane

While keeping the temperature of a vessel at 40° C., 50 g of gelatin, 0.2 g of sodium polystyrenesulfonate, 2.4 g of N,N-ethylene-bis(vinylsulfoneacetamide), 1 g of sodium t-octylphenoxyethoxy-ethanesulfonate, 30 mg of Compound 4, 32 mg of $C_8F_{17}SO_3K$, 64 mg of $C_8F_{17}SO_2N(C_3H_7)(CH_2CH_2O)_4(CH_2)_4—SO_3Na$, 8.8 g of acrylic acid/ethyl acrylate copolymer (copolymerization ratio by weight=5/95) and 950 ml of water were mixed to obtain a coating liquid for the protective layer on the back plane.

5. Preparation of Silver Halide Particle 1

A solution comprising 1421 ml of water added with 8.0 ml of an 1 wt % potassium bromide solution, 8.2 ml of an 1N nitric acid and 20 g of phthalized gelatin was kept stirred in a titanium-coated stainless reaction vessel at a constant liquid temperature of 37° C., and was then added with an entire volume of solution "A" obtained by dissolving 37.04 g of silver nitrate in distilled water and diluting it up to 159 ml, by the controlled double jet method at a constant flow rate over 1 minute while keeping pAg at 8.1. Solution "B" obtained by dissolving 32.6 g of potassium bromide in water and diluting it up to 200 ml was also added by the controlled double jet method. After that, 30 ml of 3.5 wt % aqueous hydrogen peroxide solution was added, and 36 ml of 3 wt % aqueous solution of Compound 1 was further added. Solution "A" was further diluted with distilled water to 317.5 ml to obtain solution "A2", and solution "B" was further added with Compound 2 so as to attain a final concentration thereof of $1\times10^{-4}$ mol per one mol of silver and diluted with distilled water up to doubled volume of 400 ml to obtain solution "B2". Again an entire volume of solution "A" was added to the mixture by the controlled double jet method at a constant flow rate over 10 minute while keeping pAg at 8.1. Solution "B2", was also added by the controlled double jet method. After that, the mixture was added with 50 ml of 0.5% methanol solution of Compound 3, the pAg of which adjusted to 7.5 with silver nitrate, the pH of which then adjusted to 3.8 with an 1N sulfuric acid, stopped stirring, subjected to precipitation/desalting/cleaning processes, added with 3.5 g of deionized gelatin, the pH and pAg of which adjusted to 6.0 and 8.2, respectively, with an 1N sodium hydroxide to obtain a silver halide emulsion.

Particle in the resultant silver halide emulsion was found to be a pure silver bromide particle with an average sphere-equivalent diameter of 0.053 μm and a sphere-equivalent coefficient of variation of 18%. Particle size and so forth were determined based on an average diameter of 100 particles under electron microscopic observation. Ratio of [100] plane of such particle was determined as 85% based on the method of Kubelka-Munk.

The above emulsion was kept at 38° C. under stirring, 0.035 g of Compound 4 was added (in a form of 3.5 wt % methanol solution) thereto, a solid dispersion of Spectral Sensitizing Dye "A" (aqueous gelatin solution) was added thereto 40 minutes after in an amount of $5\times10^{-3}$ mol per one mol of silver, the temperature thereof was raised to 47° C. after one minute, Compound 5 was added thereto 20 minutes after in an amount of $3\times10^{-5}$ mol per one mol of silver, Tellurium Sensitizer "B" was added thereto 2 minutes after in an amount of $5\times10^{-5}$ mol per one mol of silver, and was then ripened for 90 minutes. Immediately before completion of the ripening, 5 ml of 0.5 wt % methanol solution of Compound 6 was added, temperature of which was lowered to 31° C., and 5 ml of 3.5 wt % methanol solution of Compound 7, $7\times10^{-3}$ mol per one mol of silver of Compound 3, and $6.4\times10^{-3}$ mol per one mol of silver of Compound 8 were added to obtain a silver halide emulsion 1.

6. Preparation of Silver Halide Particle 2

An emulsion containing pure cubic silver bromide particle with an average sphere-equivalent diameter of 0.08 μm and a sphere-equivalent coefficient of variation of 15% was prepared similarly to the preparation of silver halide emulsion 1 except that the temperature of the mixed solution during particle formation was raised to 50° C., in place of 37° C. Precipitation/desalting/cleaning/dispersion were performed similarly to those in the case of silver halide emulsion 1. Except that the amount of addition of Spectral Sensitization Dye "A" is altered to $4.5\times10^{-3}$ mol per one mol of silver, the spectral sensitization, chemical sensitization, addition of Compound 3 and addition of Compound 8 were also performed similarly to those in the case of the emulsion 1, to obtain a silver halide emulsion 2.

7. Preparation of Silver Halide Particle 3

An emulsion containing pure cubic silver bromide particle with an average sphere-equivalent diameter of 0.038 μm and a sphere-equivalent coefficient of variation of 20% was prepared similarly to the preparation of silver halide emulsion 1 except that the temperature or the mixed solution during particle formation was lowered to 27° C., in place of 37° C. Precipitation/desalting/cleaning/dispersion were performed similarly to those in the case of silver halide emulsion 1. Except that the amount of addition of spectral Sensitization Dye "A" is altered to $6\times10^{-3}$ mol per one mol of silver, the spectral sensitization, chemical sensitization, addition of Compound 3 and addition of Compound 8 were also performed similarly to those in the case or the emulsion 1, to obtain a silver halide emulsion 3.

8. Preparation of Mixed Emulsion "A" for Coating Liquid

Mixed were 70 wt % of silver halide emulsion 1, 15 wt % of silver halide emulsion 2 and 15 wt % of silver halide emulsion 3, and thereto an 1 wt % aqueous solution of Compound 9 was added in an amount of $7\times10^{-3}$ mol per one mold of silver.

9. Preparation of Scaly Fatty Acid Silver Salt

Mixed were 87.6 g of behenic acid (Edenor C22-85R, manufactured by Henkel Corporation), 423 ml of distilled water, 49.2 ml of a 5N aqueous NaOH solution and 120 ml of tert-butanol, and the mixture was allowed to react at 75° C. for one hour under stirring to obtain sodium behenate solution. Independently, 206.2 ml of aqueous solution containing 40.4 g of silver nitrate (pH4.0) was prepared and kept at 10° C. A reaction vessel containing 63 ml of distilled water and 30 ml of tert-butanol was kept at 30° C., and an entire volume of the sodium behenate solution and an entire volume of the silver nitrate aqueous solution were added at constant flow rates and over 62 minutes and 10 second, and over 60 minutes, respectively. Herein only the silver nitrate aqueous solution was added in a first 7-minute-and-20-second period after the start of the addition, then sodium behenate solution was concomitantly added, and only sodium behenate solution was added in a last 9-minute-and-30 second period after the end of addition of the aqueous silver nitrate solution. The temperature in the reaction vessel is kept at 30° C., and was controlled externally so as to keep the liquid temperature constant. A piping in a feeding system of the sodium behenate solution was heated using a steam trace, where a steam aperture being adjusted so as to control the outlet liquid temperature at the end of the feed nozzle at 75° C. A piping in a feeding system of the silver nitrate aqueous solution was heated by circulating cold water in an outer portion of the double pipe. Points of addition of the sodium behenate solution and silver nitrate aqueous solution were symmetrically arranged centered around a stirring axis, the heights of which being adjusted so as to avoid contact to the reaction solution.

After completion of the addition of the sodium behenate solution, the mixture was allowed to stand for 20 minutes under stirring with the temperature thereof unchanged, and then cooled to 25° C. Solid content was separated by suction filtration, and then washed with water until electric conductivity of the filtrate decreased as low as 30 μS/cm. A fatty acid silver salt was thus obtained. The obtained solid content was stored in a form of wet cake without drying.

From electron microscopic photographing, the obtained silver behenate particle was found to be a scaly crystal having average lengths of a=0.14 μm, b=0.4 μm and c=0.6 μm, an average sphere-equivalent diameter of 0.52 μm, a sphere-equivalent coefficient of variation of 15% (a, b and c comply with the definition in this specification).

To the wet cake equivalent to dry weight of 100 g, 7.4 g of polyvinyl alcohol (product name; PVA-205) and water were added to adjust a total volume of 385 g, and the mixture was then preliminarily dispersed using a homomixer.

The preliminarily dispersed solution was dispersed three times using a dispersion apparatus (Micro Fluidizer M-110S-EH, manufactured by Micro Fluidex International Corporation, equipped with G10Z interaction chamber) under a pressure of 1750 kg/cm$^2$, to obtain a silver behenate dispersion. During the dispersion, cooling operation was effected using coiled heat exchangers attached to the inlet and outlet of the interaction chamber, and the temperature of the coolant was controlled to keep the dispersion temperature at 18° C.

10. Preparation of 25 wt % Dispersion of Reducing Agent

Ten kilograms of 1,1-bis(2-hydroxy-3,5-dimethylphenyl)-3,5,5-trimethylhexane and 10 kg of a 20 wt % aqueous solution of a modified polyvinylalcohol (Poval MP-203, manufactured by Kuraray Co. Ltd.) were added with 16 kg of water, and then mixed thoroughly to prepare a slurry. The slurry was then fed with the aid of a diaphragm pump to a lateral sand mill (UVM-2 manufacture by Aimex, Ltd.) filled with zirconia bead with an average diameter of 0.5 mm, dispersed for 3.5 hours, added with 0.2 g of Compound 10 and water so as to adjust the concentration of the reducing agent to 25 wt %, to obtain a dispersion of the reducing agent. Reducing agent particle contained in thus obtained dispersion was found to have a median diameter of 0.42 μm and a maximum diameter of 2.0 μm or less. The obtained reducing agent dispersion was filtered through a polypropylene filter with a pore size of 10.0 μm to separate dust or other foreign matters and then stored.

11. Preparation of 10 wt % Dispersion of Mercapto Compound

Five kilograms of Compound 8 and 5 kg of a 20 wt % aqueous solution of a modified polyvinyl alcohol (Poval MP-203, manufactured by Kuraray Co., Ltd.) were added with 8.3 kg of water, and then mixed thoroughly to prepare a slurry. The slurry was then fed with the aid of a diaphragm pump to a lateral sand mill (UVM-2 manufacture by Aimex, Ltd.) filled with zirconia bead with an average diameter of 0.5 mm, dispersed for 6 hours, added with 0.2 g of Compound 10 and water so as to adjust the concentration of the mercapto compound to 10 wt %, to obtain a dispersion of the mercapto compound. Mercapto compound particle contained in thus obtained dispersion was found to have a median diameter of 0.40 μm and a maximum diameter of 2.0 μm or less. The obtained mercapto compound dispersion was filtered through a polypropylene filter with a pore size of 10.0 μm to separate dust or other foreign matters and then stored.

12. Preparation of 20 wt % Dispersion-1 of Organic Polyhalogen Compound

Five kilograms of tribromoethylnaphthylsulfone, 2.5 kg of a 20 wt % aqueous solution of a modified polyvinylalcohol (Poval MP-203, manufactured by Kuraray Co., Ltd.), and 213 g of a 20 wt % aqueous solution of sodium triisopropylnaphthalenesulfonate were added with 10 kg of water, and then mixed thoroughly to prepare a slurry. The slurry was then fed with the aid of a diaphragm pump to a lateral sand mill (UVM-2 manufacture by Aimex, Ltd.) filled with zirconia bead with an average diameter of 0.5 mm, dispersed for 5 hours, added with 0.5 g of Compound 10 and water so as to adjust the concentration of the organic polyhalogen compound to 20 wt %, to obtain a dispersion of the organic polyhalogen compound organic polyhalogen compound particle contained in thus obtained dispersion was found to have a median diameter of 0.36 μm and a maximum diameter of 2.0 μm or less. The obtained organic polyhalogen compound dispersion was filtered through a polypropylene filter with a pore size of 3.0 μm to separate dust or other foreign matters and then stored.

13. Preparation of 20 wt % Dispersion-2 of Organic Polyhalogen Compound

Dispersion and filtration were performed similarly to the case with the 20 wt % diapersion-1 of the organic polyhalogen compound, except that using 5 kg of tribromomethyl (4-(2,4,6-trimerhylphenylsulfonyl)phenyl)sulfone in place of 5 kg of tribromomethylnaphthylsulfone. -sulfone. Organic polyhalogen compound particle contained in thus obtained dispersion was found to have a median diameter of 0.38 μm and a maximum diameter of 2.0 μm or less. The obtained organic polyhalogen compound dispersion was filtered through a polypropylene filter with a pore size of 3.0 μm to separate dust or other foreign matters and then stored.

14. Preparation of 20 wt % Dispersion-3 of Organic Polyhalogen Compound

Dispersion and filtration were performed similarly to the case with the 20 wt % dispersion-1 of the organic polyhalogen compound except that using 5 kg of tribromomethylphenylsulfone in place of 5 kg of tribromomethylnaphthylsulfone. Organic polyhalogen compound particle contained in thus obtained dispersion was found to have a median diameter of 0.41 μm and a maximum diameter of 2.0 μm or less. The obtained organic polyhalogen compound dispersion was filtered through a polypropylene filter with a pore size of 3.0 μm to separate dust or other foreign matters and then stored.

15. Preparation of 10 wt % Methanol Solution of Phthalazine Compound

Ten grams of 6-isopropylphthalazine was dissolved in 90 g of methanol and used.

16. Preparation of 20 wt % Dispersion of Pigment

Sixty-four grams of C.I. Pigment Blue 60 and 6.4 g of DEMOL-N (manufactured by Kao Corporation) were added with 250 g of water, and then mixed thoroughly to prepare a slurry. The slurry was then fed into a vessel of a dispersion apparatus (¼G Sand Grinder Mill manufacture by Aimex, Ltd.) together with 800 g of zirconia bead with an average diameter of 0.5 mm, and dispersed for 25 hours to obtain a pigment dispersion. Pigment particle contained in thus obtained dispersion was found to have an average diameter of 0.21 μm.

17. Preparation of 40 wt % Solution of SBR Latex

SBR latex purified by ultrafiltration was obtained as follows:

A ten-fold diluted aqueous solution of the SBR latex shown below was diluted and purified using UF-purification module FS03-FC-FUY01A1 (manufactured by Daicen Membrane-Systems Ltd.) until the ion conductivity is reduced as low as 1.5 mS/cm, Sandet-BL (manufactured by Sanyo Chemical Industries) was then added so as to attain a concentration of 0.22 wt %, and NaOH and $NH_4OH$ were further added so as to attain a molar ratio of $Na^+$:$NH_4$=1:2.3 and a pH of 8.4. The resultant latex concentration was found to be 40 wt %.

(SBR latex: expressed as -St(68)-Bu(29)-AA(3)–)

average particle size=0.1 μm, concentration=45%, equilibrium water content at, 25° C., 60%RH=0.6 wt %, ion conductivity=4.2 mS/cm (measured for latex solution (40%) at 25° C. using a conductometer CM-30S manufactured by TOA Electronics Ltd.), pH8.2

18. Preparation of Coating Liquid for Emulsion Layer (Photosensitive Layer)

Mixed were 1.1 g of the above-obtained 20 wt % dispersion of the pigment, 103 g of the organic acid silver dispersion, 5 g of a 20 wt % aqueous solution of polyvinyl alcohol PVA-205 (manufactured by Kuraray Co., Ltd.), 25 g of the above-obtained 25 wt % dispersion of the reducing agent, total 11.5 g of 5:1:3 mixture (ratio by weight) of the 20 wt % dispersions-1, -2 and -3 of the organic polyhalogen compounds, 6.2 g of the 10 wt % dispersion of the mercapto compound, 106 g of the 40 wt % solution of SBR latex purified by ultrafiltration (UF) and 16 ml of the 10 wt % methanol solution of the phthalazine compound, added was 10 g of silver halide mixed emulsion "A", then thoroughly mixed to obtain a coating liquid for the emulsion layer, which was then directly fed to a coating die and coated in an amount of 70 ml/$m^2$.

Viscosity of the coating liquid for the emulsion layer was measured using a B-type viscometer (manufactured by Tokyo Keiki K.K.) at 40° C., (with No. 1 rotor at 60 rpm) and was found to be 85 mPa·S.

Viscosities of the coating liquid measured under shearing velocities of 0.1, 1, 10, 100 and 1000 (1/second) at 25° C. using RFS Fluid Spectrometer (manufactured by Rheometrix Far East Inc.) were 1500, 220, 70, 40 and 20 mPa·s, respectively.

19. Preparation of Coating Liquid for Intermediate Layer on the Emulsion Plane

A coating liquid for the intermediate layer was prepared by mixing 772 g of a 10 wt % aqueous solution of polyvinyl alcohol PVA-205 (manufactured by Kuraray Co, Ltd.), 0.7 g of the 20 wt % dispersion of the pigment, 226 g of a 27.5 wt % solution of methyl methacrylate/styrene/butyl acrylate/hydroxyethyl methacrylate/acrylic acid copolymer latex (copolymerization ratio by weight of 59/9/26/5/1) and 2 ml of a 5 wt % aqueous solution of Aerosol 0T (American Cyanamide Corporation), which was then fed to a coating die so as to attain a coating amount of 5 ml/$m^2$.

Viscosity of the coating liquid measured at 40° C. using a B-type viscometer (with No. 1 rotor at 60 rpm) was found to be 21 mPa·S.

20. Preparation of Coating Liquid for First Protective Layer on the Emulsion Plane Sixty-four grams of inert gelatin was dissolved in water, and added thereto were 80 g of a 27.5 wt % solution of methyl methacrylate/styrene/butyl acrylate/hydroxyethyl methacrylate/acrylic acid copolymer latex (copolymerization ratio by weight of 59/9/25/5/2), 64 ml of a 10 wt % methanol solution of phthalic acid, 74 ml of a 10 wt % aqueous solution of 4-methylphthalic acid, 5 ml of a 5 wt % aqueous solution of Aerosol 0T (American Cyanamide Corporation) and 1 g of phenoxyethanol, pH of the resultant mixture was adjusted to those values listed in Table 1 using an 1N NaOH aqueous solution, added with water to total 1000 g, thereby to obtain a coating liquid for a first protective layer on the emulsion plane, which was fed to a coating die so as to attain a coating amount of 10 ml/m$^2$.

Viscosity of the coating liquid measured at 40° C. using a B-type viscometer (with No. 1 rotor at 60 rpm) was found to be 17 mPa·S.

21. Preparation of Coating Liquid for Second Protective Layer on the Emulsion Plane Eighty grams of inert gelatin was dissolved in water, and added thereto were 102 g of a 27.5 wt % solution of methyl methacrylate/styrene/butyl acrylate/hydroxyethyl methacrylate/acrylic acid copolymer latex (copolymerization ratio by weight of 59/9/25/5/2), 20 ml of a 5 wt % solution of N-perfluorooctylsulfonyl-N-propylalanine potassium salt, 50 ml of a 2 wt % aqueous solution of polyethylene-glycolmono(N-perfluorooctylsulfonyl-N-propyl-2-aminoethyl)ether [average degree of polymerization of ethylene oxide=15], 16 ml of a 5 wt % aqueous solution of Aerosol 0T (American Cyanamide Corporation), 4 g of polymethylmethacrylate microparticle (average particle size=0.7 μm), 21 g of polymethylmethacrylate micro-particle (average particle size=6.4 μm), 1.6 g of 4-methylphthalic acid, 8.1 g of phthalic acid, 10 mg of benzoisothiazolinone, added with water to total 1555 g, added with 445 ml of an aqueous solution containing 4 wt % chrome alum and 0.67% of phthalic acid using a static mixer immediately before the coating, pH of the resultant mixture was adjusted to those values listed in Table 1 using an 1NaOH aqueous solution, thereby to obtain a coating liquid for a second protective layer on the emulsion plane, which was fed to a coating die so as to attain a coating amount of 10 ml/m$^2$.

Viscosity of the coating liquid measured at 40° C. using a B-type viscometer (with No. 1 rotor at 60 rpm) was found to be 9 mPa·S.

22. Fabrication of Photothermographic Material

On the back plane of the undercoated support, the coating liquid for the antihalation layer and the coating liquid for the back plane protective layer were simultaneously formed by coating in a stacked manner, so as to attain a coated amount of 0.04 g/m$^2$ in terms of solid content of the solid particle dye for the former, and 1 g/m$^2$ in terms of gelatin for the latter, respectively. The coated films were then dried to obtain a back layer for preventing halation.

On the opposite plane of the back plane and on the undercoat layer, an emulsion layer (in a coated amount of 0.14 g/m$^2$ as silver in the silver halide), an intermediate layer, a first protective layer and a second protective layer were formed in this order by the simultaneous multi-layer coating to obtain a sample of the photothermographic material.

The coating was effected at a speed of 160 m/min while keeping a gap between the end of the coating die and the support at 0.18 mm, and adjusting so that coating width becomes wider than the width of the slit for ejecting the coating liquid by 0.5 mm each from the both edges, and keeping a pressure in a reduced pressure chamber lower by 392 Pa than the atmospheric pressure. Care was taken for handing and controlling temperature and humidity so as to prevent electric charging of the support. Next, the coated liquid was cooled in a chilling zone by blowing wind with a dry-bulb temperature of 18° C. and a wet-bulb temperature of 12° C. for 30 seconds, further dried in a helical floating drying zone by blowing wind with a dry-bulb temperature of 30° C. and a wet-bulb temperature of 18° C. for 200 seconds, still further dried in a drying zone at 90° C. for 10 seconds, then cooled to 25° C. to vaporize the solvent in the coated liquid. An average velocity of the wind blown onto the surface of the coated liquid in the chilling zone and drying zone was 7 m/s.

23 Evalution of Photographic Properties

The photographic material was exposed using a laser sensitometer, then subjected to heat development at 118° C. for 5 seconds and successively at 122° C. for 16 seconds (heat development), and density of the obtained image was measured with a densitometer.

Laser sensitometer:

35 mW outputs from two 660-nm diode laser units superposed, single-mode,

1/e$^2$ Gaussian beam spot size=100 μm,

25 μm shift in the sub-scanning direction, quadruple writing for one pixel

24. Evaluation of Coating Streaks

The coating liquids for the first and second protective layers on the side of the emulsion layer were maintained at 40° C. for 4 hours and samples obtained by the simultaneous multi-layer coating thereof were evaluated for coating streaks under candescent light.

○ good, no coating streak observed

Δ fair, a few coating streak observed

× problematic, a lot of coating streaks observed

25. Results of the Evaluation

Results obtained from the above evaluation were listed in Table 1.

TABLE 1

| Sample No. | pH of Coating Liquid for 1st Protective Layer | pH of Coating Liquid for 2nd Protective Layer | Coating Streak |
|---|---|---|---|
| 1 (Comparative Example) | 3.0 | 3.0 | × |
| 2 (Comparative Example) | 3.3 | 3.3 | × |
| 3 (Invention) | 3.6 | 3.6 | Δ |
| 4 (Invention) | 4.0 | 4.0 | ○ |
| 5 (Invention) | 4.4 | 4.4 | ○ |
| 6 (Invention) | 4.4 | 3.0 | ○ |
| 7 (Invention) | 4.4 | 3.3 | ○ |
| 8 (Invention) | 3.0 | 4.4 | ○ |
| 9 (Invention) | 3.3 | 4.4 | ○ |

As is clear from Table 1, the photosensitive materials according to the present invention using the coating liquid for the surface protective layer (non-recordable layer) having a pH of 3.5 or above allowed higher maximum image density and successfully prevented coating streaks even after the simultaneous coating.

Example 2

(Preparation of Solid Microparticle Dispersion of Toning Agent)

As a color toner, 2.9 g of 6-isopropylphthalazine was added to ethyl acetate and dissolved by stirring, and was further added with an aqueous solution obtained by dissolving 1.6 g of modified polyvinyl alcohol (Poval MP-203 manufactured by Kuraray Co., Ltd.) in water, and the mixture was then subjected to a high-speed mixing using a homogenizer. Ethyl acetate was thoroughly vaporized off to obtain a solid microparticle dispersion of the color toner. The particle size of 70 wt % of the particle was found to be 0.5 to 1.0 μm.

A sample was fabricated similarly to Sample 5 in Example 1 except that adding the above dispersion (solid content thereof being the same as in Sample 5) in place of the methanol solution of the phthalazine compound during the preparation of the coating liquid for the emulsion layer (photosensitive layer). This enhanced the sensitivity by 25% without increasing fog, and significantly improved the aging stability of the photosensitive material per se.

Example 3

SBR latex was used after pH thereof adjusted to 8.0 using a $NH_4OH$ and NaOH (with a molar ratio of 1:1) while not being purified by ultrafiltration. Results were the same as those in Example 1.

Example 4

A sample was fabricated similarly to Example 3, except that the equal weight of polyvinyl alcohol PVA-217 (manufactured by Kuraray Co., Ltd.) was used in place of golatin in the first and second protective layers on the emulsion surface, and that omitting chrome alum. Results were the same as those in Example 3.

What is claimed is:

1. A thermally processed image forming material having on one side of a support at least one image recording layer containing at least one non-photosensitive organic silver salt, a reducing agent for silver ion, and a binder; characterized by having at least one non-recordable layer formed by coating and drying a coating liquid containing a dicarboxylic acid and having a pH of 3.5 or above.

2. The thermally processed image forming material as claimed in claim 1, wherein water content of the total solvent contained in the coating liquid is 50 wt % or more.

3. The thermally processed image forming material as claimed in claim 2, wherein water content of the total solvent contained in the coating liquid is 80 wt % or more.

4. The thermally processed image forming material as claimed in claim 3, wherein water content of the total solvent contained in the coating liquid is 95 to 100 wt %.

5. The thermally processed image forming material as claimed in claim 1, wherein the dicarboxylic acid is selected from the group consisting of phthalic acids, maleic acids and naphthalenedicarboxylic acids.

6. The thermally processed image forming material as claimed in claim 5, wherein the dicarboxylic acid is selected from the group consisting of phthalic acid, 4-methylphthalic acid, 4-t-butylphthalic acid, 3-methylphthalic acid, 4,5-dimethylphthalic acid, 4-isopropyl-phthalic acid, 4-nitrophthalic acid, tetrachlorophthalic anhydride, maleic acid, and 2,3-naphthalenedicaroboxylic acid.

7. The thermally processed image forming material as claimed in claim 1, wherein the dicarboxylic acid is contained in an amount of 1 to 2000 $mg/m^2$ in the non-recordable layer.

8. The thermally processed image forming material as claimed in claim 7, wherein the dicarboxylic acid is contained in an amount of 30 to 1000 $mg/m^2$ in the non-recordable layer.

9. The thermally processed image forming material as claimed in claim 1, wherein the dicarboxylic acid is contained in a surface protective layer.

10. The thermally processed image forming material as claimed in claim 1, wherein the coating liquid has an pH of 3.5 to 5.0.

11. The thermally processed image forming material as claimed in claim 10, wherein the coating liquid has an pH of 3.5 to 4.5.

12. The thermally processed image forming material as claimed in claim 1, wherein the image recording layer and the non-recordable layer are formed by simultaneous multi-layer coating.

13. The thermally processed image forming material as claimed in claim 1, wherein the material is a photothermographic material further containing at least one photosensitive silver halide.

* * * * *